US008674292B2

(12) United States Patent
Vestal

(10) Patent No.: US 8,674,292 B2
(45) **Date of Patent: *Mar. 18, 2014**

(54) REFLECTOR TIME-OF-FLIGHT MASS SPECTROMETRY WITH SIMULTANEOUS SPACE AND VELOCITY FOCUSING

(75) Inventor: Marvin L. Vestal, Framingham, MA (US)

(73) Assignee: Virgin Instruments Corporation, Sudbury, MA (US)

( * ) Notice: Subject to any disclaimer, the term of this patent is extended or adjusted under 35 U.S.C. 154(b) by 236 days.

This patent is subject to a terminal disclaimer.

(21) Appl. No.: 13/034,525

(22) Filed: Feb. 24, 2011

(65) Prior Publication Data

US 2012/0145889 A1 Jun. 14, 2012

Related U.S. Application Data

(63) Continuation-in-part of application No. 12/968,254, filed on Dec. 14, 2010.

(51) Int. Cl.
*H01J 49/40* (2006.01)

(52) U.S. Cl.
USPC ..... 250/287

(58) Field of Classification Search
USPC ..... 250/287
See application file for complete search history.

(56) References Cited

U.S. PATENT DOCUMENTS 5,087,815 A 2/1992 Schultz et al.
5,144,127 A 9/1992 Williams et al.
5,160,840 A 11/1992 Vestal
5,625,184 A 4/1997 Vestal et al.
5,627,369 A 5/1997 Vestal et al.
5,847,385 A 12/1998 Dresch
6,057,543 A 5/2000 Vestal et al.
6,300,627 B1 10/2001 Koster et al.

(Continued)

FOREIGN PATENT DOCUMENTS

WO 2006-064280 A2 6/2006

OTHER PUBLICATIONS

"Notification of Transmittal of the International Search Report and the Written Opinion of the International Searching Authority, or the Declaration" for PCT/US2012/025761, Sep. 25, 2012, 9 pages, International Searching Authority/KR, Daejeon Metropolitan City, Republic of Korea.

(Continued)

*Primary Examiner* — Jack Berman
*Assistant Examiner* — Eliza Osenbaugh-Stewart
(74) *Attorney, Agent, or Firm* — Kurt Rauschenbach; Rauschenbach Patent Law Group, LLC

(57) ABSTRACT

A time-of-flight mass spectrometer includes an ion source that generates ions. A two-field ion accelerator accelerates the ions through an ion flight path. A pulsed ion accelerator focuses the ions to a first focal plane where the ion flight time is substantially independent to first order of an initial velocity of the ions prior to acceleration. An ion reflector focuses ions to a second focal plane where the ion flight time is substantially independent to first order of an initial velocity of the ions prior to acceleration. An ion detector positioned at the second focal plane detects the ions. The two-field ion accelerator and the ion reflector cause the ion flight time to the ion detector for the ion of predetermined mass-to-charge ratio to be substantially independent to first order of both the initial position and the initial velocity of the ions prior to acceleration.

23 Claims, 11 Drawing Sheets

(56) References Cited

U.S. PATENT DOCUMENTS

| | | | |
|---|---|---|---|
| 6,489,610 | B1 | 12/2002 | Barofsky et al. |
| 6,512,225 | B2 | 1/2003 | Vestal et al. |
| 6,534,764 | B1 | 3/2003 | Verentchikov et al. |
| 6,621,074 | B1 | 9/2003 | Vestal |
| 6,872,941 | B1 | 3/2005 | Whitehouse et al. |
| 7,214,320 | B1 | 5/2007 | Gregori et al. |
| 7,223,966 | B2 | 5/2007 | Weiss et al. |
| 7,355,169 | B2 | 4/2008 | McLuckey et al. |
| 7,564,026 | B2 | 7/2009 | Vestal |
| 7,564,028 | B2 | 7/2009 | Vestal |
| 7,589,319 | B2 | 9/2009 | Vestal |
| 7,663,100 | B2 | 2/2010 | Vestal |
| 7,667,195 | B2 | 2/2010 | Vestal |
| 2002/0158194 | A1 | 10/2002 | Vestal et al. |
| 2005/0116162 | A1 | 6/2005 | Vestal |
| 2005/0269505 | A1 | 12/2005 | Ermer |
| 2006/0266941 | A1 | 11/2006 | Vestal |
| 2008/0078931 | A1 | 4/2008 | Vestal et al. |
| 2008/0272291 | A1 | 11/2008 | Vestal |
| 2009/0294658 | A1 | 12/2009 | Vestal et al. |
| 2010/0181473 | A1 | 7/2010 | Blenkinsopp et al. |
| 2010/0301202 | A1 | 12/2010 | Vestal |

OTHER PUBLICATIONS

"Notification Concerning Transmittal of International Preliminary Report on Patentability (Chapter I of the Patent Cooperation Treaty" for PCT/US2010/046074, Mar. 8, 2012, 5 pages, The International Bureau of WIPO, Geneva, Switzerland.

Beavis, Ronald C., et al., Factors Affecting the Ultraviolet Laser Desorption of Properties, Rapid Communications in Mass Spectrometry, 1989, pp. 233-237, vol. 3 No. 9, Heyden & Son Limited.

Bergmann, T., et al., High-Resolution Time-Of-Flight Mass Spectrometer, Rev. Sci. Instrum., Apr. 1989, pp. 792-793, vol. 60, No. 4, American Institute of Physics.

Beussman, Douglas J., et al., Tandem Reflectron Time-Of-Flight Mass Spectrometer Utilizing Photodissociation, Analytical Chemistry, Nov. 1, 1995, pp. 3952-3957, vol. 67, No. 21, American Chemical Society.

Colby, Steven M., et al., Space-Velocity Correlation Focusing, Analytical Chemistry, Apr. 15, 1996, pp. 1419-1428, vol. 68, No. 8, American Chemical Society.

Cornish, Timothy J., et al., A Curved Field Reflectron Time-Of-Flight Mass Spectrometer for the Simultaneous Focusing of Metastable Product Ions, Rapid Communication in Mass Spectrometry, 1994 pp. 781-785, vol. 8, John Wiley & Sons.

Cornish, Timothy J., et al., Tandem Time-Of-Flight Mass Spectrometer, Analytical Chemistry, Apr. 15, 1993, pp. 1043-1047, vol. 65, No. 8.

Hillenkamp, F., Laser Desorption Mass Spectrometry: Mechanisms, Techniques and Applications, 1989, pp. 354-362, vol. 11A, Heyden & Son, London.

Kaufmann, R., et al., Mass Spectrometric Sequencing of Linear Peptides by Product-Ion Analysis in a Reflectron Time-Of-Flight Mass Spectrometer Using Matrix Assisted Laser Desorption Ionization, Rapid Communications in Mass Spectrometry, 1993, pp. 902-910, vol. 7, John Wiley & Sons, Ltd.

Mamyrin, B.A. et al., The Mass-Reflectron, A New Nonmagnetic Time-Of-Flight Mass Spectrometer With High Resolution, Sov. Phys. 1973, pp. 45-48, vol., 37, No. 1, American Institute of Physics.

Matsuda, H., et al., Particle Flight Times Through Electrostatic and Magnetic Sector Fields and Quadrupoles to Second Order, International Journal of Mass Spectrometry and Ion Physics, 1982, pp. 157-168, vol. 42, Elsevier Scientific Publishing Company, Amsterdam, The Netherlands.

Neuser, H. J., et al., High-Resolution Laser Mass Spectrometry, International Journal of Mass Spectrometry and Ion Process, 1984, pp. 147-156, vol. 60, Elsevier Science Publishers B.V., Amsterdam, The Netherlands.

Vestal, M. L., et al., Delayed Extraction Matrix-Assisted Laser Desorption Time-Of-Flight Mass Spectrometry, Rapid Communications in Mass Spectrometry, 1995, pp. 1044-1050, Vol. 9, John Wiley & Sons, Ltd.

Vestal, M. L., et al., Resolution and Mass Accuracy in Matrix Accuracy in Matrix-Assisted Laser Desorption Ionization-Time-Of-Flight, American Society for Mass Spectrometry, 1998, pp. 892-911, Elsevier Science, Inc.

Vestal, M., High Performance MALDI-TOF Mass Spectrometry for Proteomics, International Journal of Mass Spectrometry, 2007, pp. 83-92.

Wiley, W. C., et al., Time-Of-Flight Mass Spectrometer With Improved Resolution, The Review of Scientific Instruments, Dec. 1955, pp. 1150-1157, Vol. 26, No. 13.

Zhou, J. Kinetic Energy Measurements of Molecular Ions Ejected Into an Electric Field by Matrix-Assisted Laser Desorption, Rapid Communications in Mass Spectrometry, Sep. 1992, pp. 671-678, vol. 6, John Wiley & Sons, Ltd.

Vestal, M., Quantitative Measurement of Isotope Ratios by Time-Of-Flight Mass Spectrometry, U.S. Appl No. 12/365,354, filed Feb. 4, 2009.

Vestal, M., Tandem TOF Mass Spectrometer With High Resolution Precursor Selection and Multiplexed MS-MS, U.S. Appl. No. 12/475,432, filed May 29, 2009.

Vestal, M., Tandem TOF Mass Spectrometer With Pulsed Accelerator to Reduce Velocity Spread, U.S. Appl. No. 12/549,076, filed Aug. 27, 2009.

Vestal, M., Merged Ion Beam Tandem TOF-TOF Mass Spectrometer, U.S. Appl. No. 12/651,070, filed Dec. 31, 2009.

Vestal, M., Tandem TOF Mass Spectrometer With High Resolution Precursor Selection and Multiplexed MS-MS and MS-MS Operation, U.S. Appl. No. 12/770,794, filed Apr. 30, 2010.

Vestal, M., Linear Time-Of-Flight Mass Spectrometry With Simultaneous Space and Velocity Focusing, U.S. Appl. No. 12/968,254, filed Dec. 14, 2010.

"Notification Concerning Transmittal of International Preliminary Report on Patentability (Chapter I of the Patent Cooperation Treaty)" for PCT/US2009/045108, Dec. 9, 2010, 9 pages, The International Bureau of WIPO, Geneva, Switzerland.

"Notification Concerning Transmittal of International Preliminary Report on Patentability (Chapter I of the Patent Cooperation Treaty" for PCT/US2010/060902, Jul. 12, 2012, 7 pages, The International Bureau of WIPO, Geneva, Switzerland.

"Notification of Transmittal of the International Search Report and the Written Opinion of the International Searching Authority, or the Declaration" for PCT/US2011/063855, Jul. 27, 2012, 11 pgs., International Searching Authority/Korea, Korean Intellectual Property Office, Daejeon Metropolitan City, Republic of Korea.

"Office Action" for U.S. Appl. No. 12/651,070, filed Dec. 9, 2011, 31 pages, United States Patent Office, Alexandria, VA, US.

"Office Action" for U.S. Appl. No. 12/651,070, filed May 24, 2011, 50 pages, United States Patent Office, Alexandria, VA, US.

"Office Action" for U.S. Appl. No. 12/968,254, filed May 14, 2012, 23 pages, United States Patent Office, Alexandria, VA, US.

"Notifaction Concerning Transmittal of International Preliminary Report on Patentability" For PCT/US2012/02571, Sep. 6, 2013, 6 pages, The International Bureau of WIPO, Geneva, Switzerland.

REFLECTOR TIME-OF-FLIGHT MASS SPECTROMETRY WITH SIMULTANEOUS SPACE AND VELOCITY FOCUSING

CROSS REFERENCE TO RELATED APPLICATIONS

This patent application is a continuation-in-part of U.S. patent application Ser. No. 12/968,254, filed Dec. 14, 2010, entitled "Linear Time-Of-Flight Mass Spectrometry with Simultaneous Space and Velocity Focusing," which is incorporated herein by reference.

FEDERAL RESEARCH STATEMENT

This invention was made with Government support under SBIR Grant Number 1R44RR025705 awarded by the National Institutes of Health. The Government has certain rights in this invention.

The section headings used herein are for organizational purposes only and should not to be construed as limiting the subject matter described in the present application in any way.

INTRODUCTION

The first practical time-of-flight (TOF) mass spectrometer was described by Wiley and McClaren more than 50 years ago. TOF mass spectrometers were generally considered to be only a tool for exotic studies of ion properties for many years. See, for example, "Time-of-Flight Mass Spectrometry: Instrumentation and Applications in Biological Research," Cotter R J., American Chemical Society, Washington, D.C. 1997, for review of the history, development, and applications of TOF-MS in biological research.

Early TOF mass spectrometer systems included ion sources with electron ionization in the gas phase where a beam of electrons is directed into the ion source. The ions produced have a distribution of initial positions and velocities that is determined by the intersection of the electron beam with the neutral molecules present in the ion source. The initial position of the ions and their velocities are independent variables that affect the flight time of the ions in a TOF-MS. Wiley and McLaren developed and demonstrated methods for minimizing the contribution of each of these distributions. Techniques for minimizing the contribution of initial position are called "space focusing" techniques. Techniques for minimizing the contribution of initial velocity are called "time lag focusing" techniques. One important conclusion made by Wiley and McLaren is that it is impossible to simultaneously achieve both space focusing and velocity focusing. Optimization of these TOF mass spectrometers required finding the optimum compromise between the space focusing and velocity focusing distributions.

The advent of naturally pulsed ion sources such as CF plasma desorption ions source, static secondary ion mass spectrometry (SIMS), and matrix-assisted laser desorption/ionization (MALDI) ion sources has led to renewed interest in TOF mass spectrometers. Recent work in TOF mass spectrometry has focused on developing new and improved TOF instruments and software that take advantage of MALDI and electrospray (ESI) ionization sources. These ionization sources have removed the volatility barrier for mass spectrometry and have facilitated the use of mass spectrometers for many important biological applications.

The ion focusing techniques used with MALDI and electrospray (ESI) ion sources reflect the practical limits on the position and velocity distributions that can be achieved with these techniques. Achieving optimum performance with electrospray ionization and MALDI ionization methods requires finding the best compromise between space and velocity focusing. Electrospray ionization methods have been developed to improve space focusing. Electrospray ionization forms a beam of ions with a relatively broad distribution of initial positions and a very narrow distribution in velocity in the direction that ions are accelerated.

In contrast, MALDI ionization methods have been developed to improve velocity focusing. MALDI ionization methods use samples deposited in matrix crystals on a solid surface. The variation in the initial ion position is approximately equal to the size of the crystals. The velocity distribution is relatively broad because the ions are energetically ejected from the surface by the incident laser irradiation.

Ion reflectors, which are sometimes referred to in the art as ion reflectors and reflectrons, have been used to improve the resolving power of time-of-flight mass spectrometers. Ion reflectors generate one or more homogeneous, retarding, electrostatic fields that compensate for the effects of the initial kinetic energy distribution. As the ions penetrate the ion reflector, with respect to the electrostatic fields, they are decelerated until the velocity component of the ions in the direction of the electrostatic field becomes zero. The ions then reverse direction and are accelerated back through the ion reflector. The ions exit the ion reflector with energies that are identical to their incoming ion energy but, with ion velocities in the opposite direction. The result is that ions with larger energies penetrate the ion reflector more deeply and consequently will remain in the ion reflector for a longer time. In a properly designed ion reflector, the potentials are selected to modify the flight paths of the ions such that ions of like mass and charge arrive at the detector at the same time regardless of their initial energy Ion reflectors compensate for the effects of the initial kinetic energy distribution by increasing the effective length of the time-of-flight mass spectrometer without increasing the undesirable contributions to the mass-to-charge ratio peak width. In practice, ion reflectors can be used to achieve optimal or near optimal performance using practical time-of-flight mass spectrometer physical dimensions.

BRIEF DESCRIPTION OF THE DRAWINGS

The present teachings, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the invention. The drawings are not intended to limit the scope of the Applicant's teachings in any way.

DEFINITIONS

Figure 1:
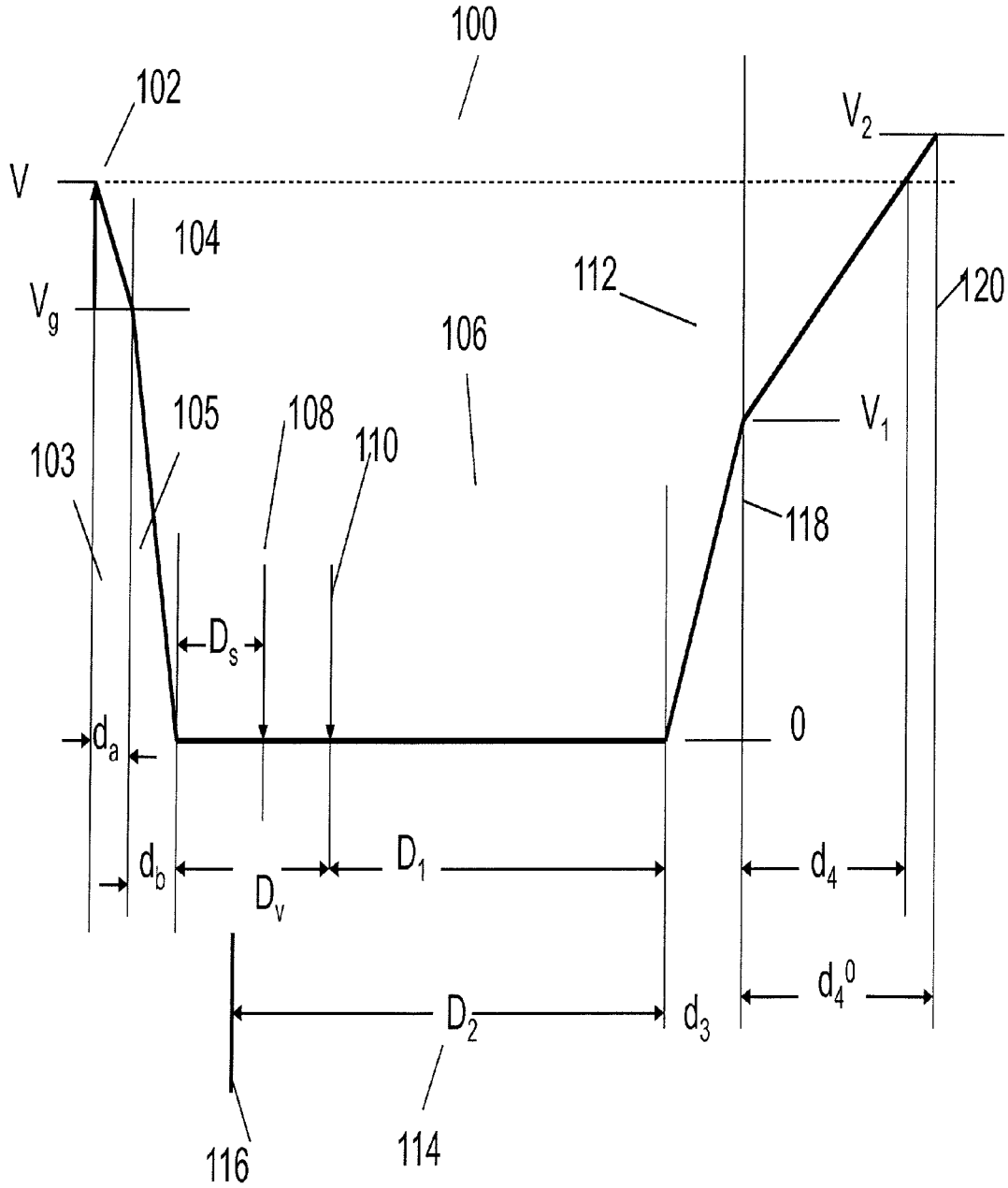
FIG. 1 Prior Art
FIG. 1 illustrates a potential diagram for a known reflector TOF mass spectrometer comprising a pulsed two-field ion accelerator, a drift tube, a two-field ion reflector, and an ion detector.

The following variables are used in the Description of Various Embodiments:

D=Distance in a field-free region;
$D_v$=Distance to the first order velocity focus point;
$D_s$=Distance to the first order spatial focus point;
$D_e$=Effective length of an equivalent field-free region;
$D_{es}$=Effective length of a two-field accelerating field;
$D_{em}$=Effective length of a two-field ion reflector;
$D_a$=Distance from the end of the static field to a predetermined position in the pulsed accelerating field;
$d_a$=Length of the first accelerating field;
$d_b$=Length of the second accelerating field;
$d_l$=Length of the pulsed acceleration region;
δd=position of an ion with initial velocity $v_0$ relative to that with zero initial velocity in pulsed acceleration region;
$d_3$=Length of first field of a two-stage ion reflector;
$d_4$=Length of second field of a two-stage ion reflector;
δx=Spread in initial position of the ions;
Δt=Time lag between the ion production and the application of the accelerating field;
p=Total effective perturbation accounting for all of the initial conditions;
$p_1$=perturbation due to initial velocity distribution;
$p_2$=perturbation due to initial spatial distribution;
V=Total acceleration potential;
$V_g$=Voltage applied to the extraction grid;
$v_n$=Nominal final velocity of the ion after acceleration;
$V_p$=amplitude of the pulsed voltage;
y=Ratio of the total accelerating potential V to the accelerating potential difference in the first field;
$V_1$=Voltage applied to the first stage of a two-field ion reflector;
$V_2$=Voltage applied to the second stage of a two-field ion reflector;
w=voltage ratio in two-field ion reflector;
$m_0$=Mass of the ion focused to first order at the detector;
δt=Width of the peak at the detector; and
$δv_0$=Initial velocity spread of the ions.

DESCRIPTION OF VARIOUS EMBODIMENTS

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

It should be understood that the individual steps of the methods of the present teachings may be performed in any order and/or simultaneously as long as the invention remains operable. Furthermore, it should be understood that the apparatus and methods of the present teachings can include any number or all of the described embodiments as long as the invention remains operable.

The present teachings will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teachings herein will recognize additional implementations, modifications, and embodiments, as well as other fields of use, which are within the scope of the present disclosure as described herein.

Known TOF mass spectrometers include ions sources with pulsed ion acceleration. The pulsed acceleration in the ion source provides first order velocity focusing for a single selected ion. However, the pulsed acceleration in the ion source cannot focus a broad range of masses. In addition, the pulsed acceleration in the ion source does not correct for variations in the ion initial position.

FIG. 1 illustrates a potential diagram 100 for a known reflector TOF mass spectrometer comprising a pulsed ion source with a two-field ion accelerator, a drift tube, a two-field ion reflector, and an ion detector. In this known reflector TOF mass spectrometer, pulsed and static electric fields are used to accelerate and focus the ions in both space and time. The potential diagram 100 shows the total accelerating potential V at the sample plate position 102 where the sample is ionized. The voltage $V_g$ is the potential applied to the extraction electrode position 104 that is a distance $d_a$ from the sample plate position 102. The ions are accelerated through a first acceleration region 103 that extends a distance $d_a$. The extraction electrode is biased at potential $V_g$. The ions are extracted by the extraction electrode through a distance $d_b$ in a second acceleration region 105 to a field-free region 106. The ions travel a distance $D_s$ in the field-free region 106 to the spatial focus point 108. The ions travel a distance $D_v$ to the velocity focus point 110. The ions continue to travel through field-free region 106 to ion reflector 112 where they are reflected and then travel through field-free region 114 a distance $D_2$ to a detector 116 where the ions are detected. Voltages $V_1$ and $V_2$ are applied to ion reflector electrodes 118 and 120, respectively to focus ions from the velocity focus point 110 to the detector 116 thereby removing the first and second order contributions of initial velocity to the ion flight time.

The ideal pulsed ion source produces a narrow, nearly parallel beam with all ions of each m/z arriving at a detector with a flight time that is nearly independent of the initial position and the initial velocity of the ions. The general conditions for both space and time focusing were described by Wiley and McLaren and focusing by a two-field ion reflector was described by Mamyrin.

A linear TOF mass spectrometer has limited resolving power over mass ranges of interest. The addition of an ion reflector extends the ion flight time range without significantly affecting the peak mass-to-charge ratio widths. Thus, the use of ion reflectors can substantially increase the resolving power of a TOF mass spectrometer. The condition for first and second order focusing at a distance $D=D_1+D_2$ by a two-field ion reflector is given by $$(4d_4/D)=w^{-3/2}+(4d_3/D)/(w+w^{1/2}),$$

where $w=V/(V-V_1)$ and $d_4=d_4^0(V-V_1)/(V_2-V_1)$, and where $d_4^0$ is the physical length of the second stage of the ion reflector and $V_1$ and $V_2$ are the voltages applied to the first and second stage, respectively, of the ion reflector. The nominal flight time for the known reflector TOF mass spectrometer having the potential diagram shown in FIG. 1 is $$t=(D_e/v_n),$$

where $D_e$ is the effective length of an equivalent field-free region and can be expressed as $$D_e=D_{es}+D_v+D_1+D_2+D_{em}$$

where $D_{es}$ is the effective length of the accelerating region which can be represented as $D_{es}=2d_a y^{1/2}[1+(d_b/d_a)/(y^{1/2}+1)]$ and $D_{em}$ is the effective length of the ion reflector, which can be represented as $$D_{em}=4d_2w^{1/2}+4d_3w^{1/2}/(w^{1/2}+1).$$

The velocity $v_n$ in units of m/s is given by the following equation:

$$v_n=C_1(zV/m)^{1/2},$$

where the numerical constant $C_1$ is given by $$C_1=(2z_0/m_0)^{1/2}=[2\times1.60219\times10^{-19}coul/1.66056\times10^{-27}\,kg]^{1/2}=1.38914\times10^4.$$

and the voltage V is in units volts and the mass m is in units of Da.

The focal lengths for first order space and velocity focusing are given by $$D_s=2d_a y^{3/2}[1-(d_b/d_a)/(y^{1/2}+y)] \text{ and}$$

$$D_v=D_s+(2d_a y)^2/(v_n{}^*\Delta t)$$

The time $\Delta t$ is the time lag between the ion production and the application of the accelerating field and $v_n{}^*$ is the nominal final velocity of the ions of mass m* that are focused at the velocity focus point $D_v$ and is given by $$v_n{}^*=C_1(V/m^*)^{1/2}.$$

In known reflector TOF mass spectrometers, the parameters are adjusted to place the velocity focus plane 110 at a predetermined position in the field-free region 106. It has been discovered that for a given mass spectrometer geometry, the space focus $D_s$ can be adjusted by varying the voltage ratio $y=V_a/(V_a-V_g)$, and the difference between the space focus $D_s$ and the velocity focus $D_v$ can be independently adjusted by varying the time lag between the ion production and the application of the accelerating field $\Delta t$.

The contribution to the mass-to-charge ratio peak width ($\delta m/m$) due to the initial position $\delta x$ is $$R_{s1}=2[(D_v-D_s)/2d_a y]/[\delta x/(D_e)],$$

where $D_e=(D_{es}+D_v+D_1+D_2+D_{em})$.

The first order contributions to the mass-to-charge ratio peak width ($\delta m/m$) due to the initial velocity $\delta v$ is $$R_{v1}=2[2d_a y/(D_e/[\delta v_0/v_n][1-(m_0/m)^{1/2}].$$

The second order contributions to the mass-to-charge ratio peak width ($\delta m/m$) due to the initial velocity $\delta v$ is $$R_{v2}=2[(D_{es}+D_v)/D_e][2d_a y/(D_v-D_s)]^2/[\delta v_0/V_n]^2.$$

The third order contribution is $$R_{v3}=2[(D_1+D_2+D_{em})/D_e][2d_a y/(D_v-D_s)]^3/[\delta v_0/V_n]^3.$$

Thus, the effective length of the TOF analyzer with an ion reflector is much larger than the comparable linear mass spectrometer. In addition, the resolving power at the focused mass $m_0$ is substantially improved. Furthermore, the variation in resolving power with mass is reduced.

The present teaching relates to mass spectrometer apparatus that include at least one ion reflector and to methods of mass spectrometry that provide simultaneous space and velocity focusing for an ion of predetermined mass-to-charge ratio. In addition, the present teaching relates to mass spectrometers apparatus and methods that provide high mass resolution performance for a broad range of ions.

One aspect of the present teaching is that it has been discovered that pulsed acceleration in the ion source is not required to achieve velocity focusing. It has also been discovered that pulsed acceleration can be used for initiating time-of-flight measurements when a continuous beam of ions is generated. Furthermore, it has been discovered that higher mass resolution can be achieved by using pulsed acceleration for initiating TOF measurements.

Figure 2:
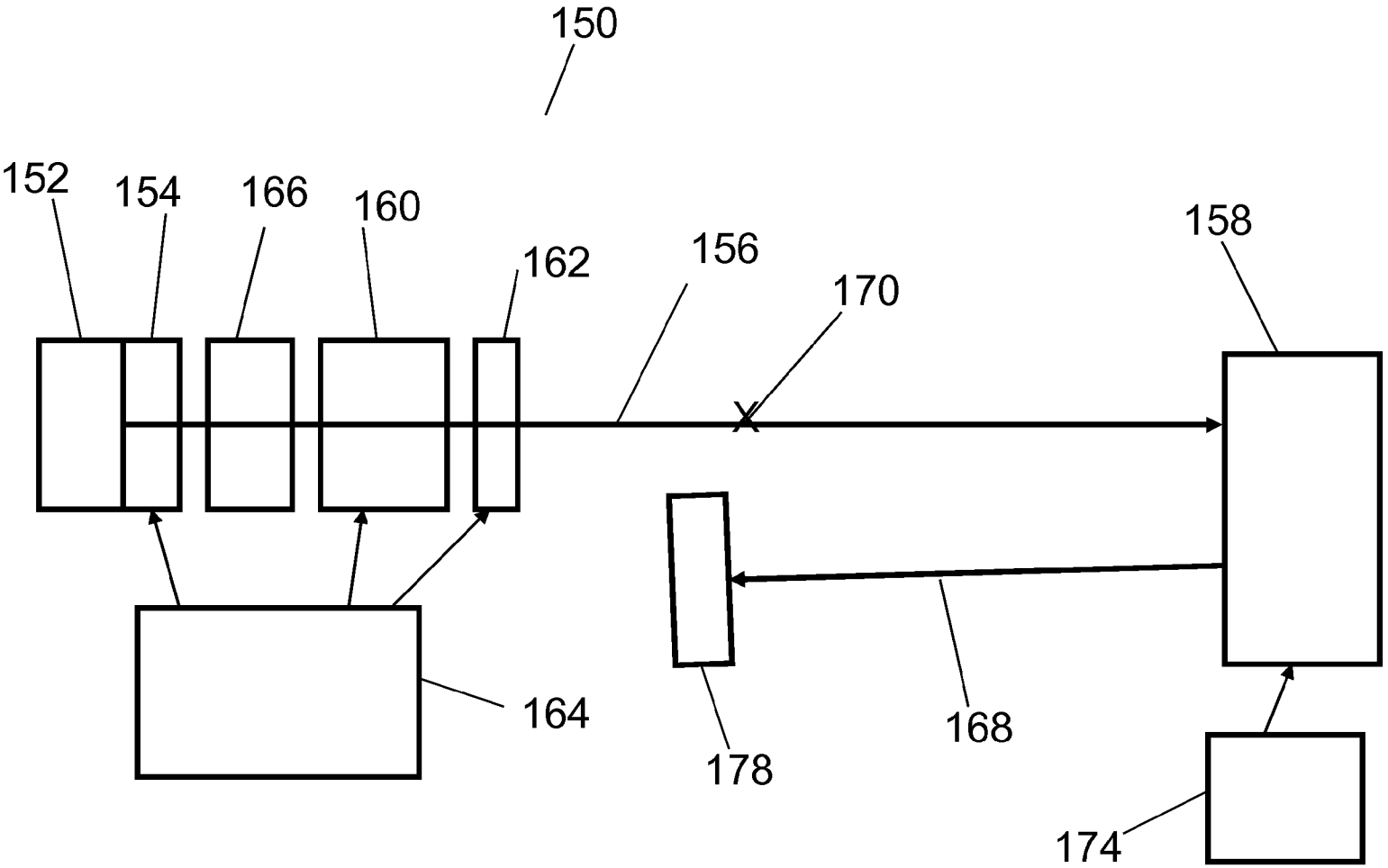
FIG. 2 shows a block diagram of a reflector TOF mass spectrometer according to the present teaching.

FIG. 2 shows a block diagram of a reflector TOF mass spectrometer 150 according to the present teaching that includes an ion source 152, a two-field ion accelerator 154, an ion flight path 156, an ion reflector 158, and an ion detector 178. The ion flight path 156 can include at least one field-free region. A pulsed ion accelerator 160 is positioned in the ion flight path 156 between the two-field ion accelerator 154 and the ion reflector 158. A timed ion selector 162 is positioned in the ion flight path 156 between the pulsed ion accelerator 160 and the ion reflector 158. The ion detector 178 is positioned at the end of second ion flight path 168.

A voltage generator 164 supplies voltages to the two-field ion accelerator 154, to the pulsed ion accelerator 160, and to the timed ion selector 162. In various other embodiments, two or three separate voltage generators can be used to independently provide voltages to one or more of the two-field ion accelerator 154, the pulsed ion accelerator 160, and the timed ion selector 162. The voltages supplied by the voltage generator 164 to the two-field ion accelerator 154 and to the pulsed ion accelerator 160 accelerate and focus the ions to focal point 170 in ion flight path 156 where the ion flight time for an ion of predetermined mass-to-charge ratio is independent to first order of both the initial position and the initial velocity of the ions prior to acceleration. Ion reflector 158 reflects ions to detector 178 at the end of second ion flight path 168. Voltages supplied by voltage generator 174 to the ion reflector 158 causes the ion reflector 158 to refocus the ions from focal point 170 to the ion detector 178, where the ion flight time for an ion of predetermined mass-to-charge ratio is independent to first order of both the initial position and the initial velocity of the ions prior to acceleration.

The timed ion selector 162 transmits ions accelerated by pulsed ion accelerator 160 and reflected by the ion reflector 158 to the ion detector 178 and prevents all other ions from reaching the ion detector 178. In some embodiments, ion focusing and ion steering elements 166 known in the art are positioned in the ion flight path 156 between the two-field ion accelerator 154 and the pulsed ion accelerator 160 to enhance the transmission of ions to the ion detector 178.

There are various modes of operating the reflector TOF mass spectrometer 150 according to the present teaching. In one mode of operation according to the present teaching, the ion source 152 is a pulsed ion source and the two-field ion accelerator 154 generates a static electric field. In another mode of operation according to the present teaching, the ion source 152 is a continuous source of ions and the two-field ion accelerator 154 generates a pulsed electric field and a static electric field.

Figure 3:
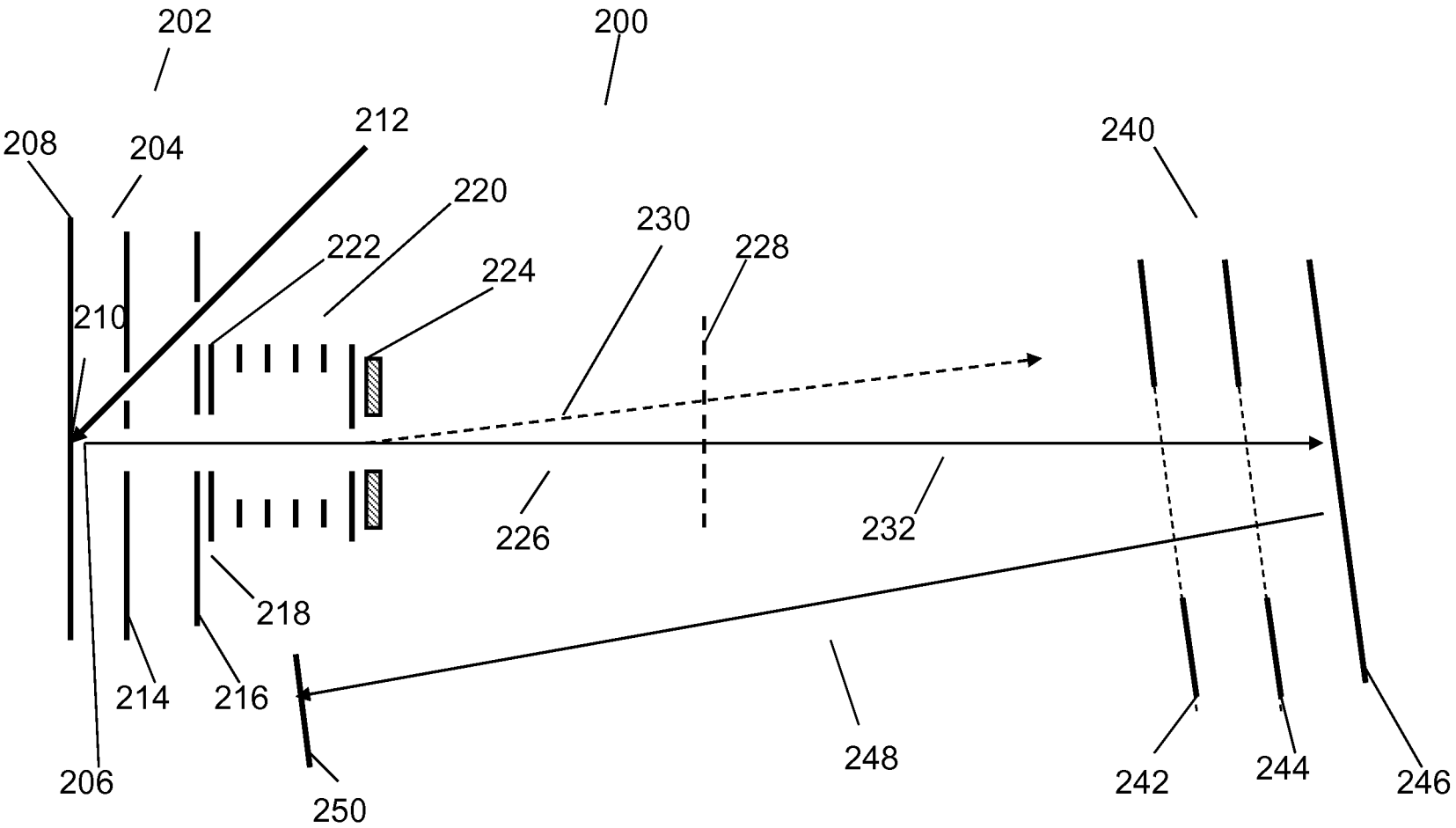
FIG. 3 shows a schematic diagram of a reflector TOF mass spectrometer according to the present teaching that includes an ion source with a static ion accelerator.

FIG. 3 shows a schematic diagram of a reflector TOF mass spectrometer 200 according to the present teaching that includes an ion source 202 with a static ion accelerator 204. The ion source 202 generates a pulse of ions 206. The ion source 202 includes a sample plate 208 that positions a sample 210 for analysis. An energy source, such as a laser, is positioned to provide a beam of energy 212 to the sample 210 positioned on the sample plate 208 that ionizes sample material. The beam of energy 212 can be a pulsed beam of energy, such as a pulsed beam of light.

The static ion accelerator 204 includes a first 214 and second electrode 216 positioned adjacent to the sample plate 208. A pulsed ion accelerator 220 is positioned adjacent to a second electrode 216. In some embodiments, a first field-free ion drift space 218 is positioned between electrode 216 and pulsed ion accelerator 220. The pulsed ion accelerator 220 includes an entrance plate 222. A timed ion selector 224 is positioned adjacent to the pulsed ion accelerator 220. A field-free ion drift space 226 is positioned adjacent to the timed ion selector 224. The ions travel a distance $D_v$ to the velocity focus point 228. The ions continue to travel through a field-free region 232 to an ion reflector 240 where they are reflected to travel through field-free region 248 to an ion detector 250.

In operation, a beam of energy 212, which can be a pulsed beam of energy, is generated and directed to the sample 210 positioned on the sample plate 208. The pulsed beam of energy 212 can be a pulsed laser beam that produces ions from samples present in the gas phase. An energetic pulse of ions can also be produced by secondary ionization mass spectrometry (SIMS). In some methods of operation, the sample 210 includes a UV absorbing matrix and ions are produced by matrix assisted laser desorption ionization (MALDI).

The static ion accelerator 204 is biased with a DC voltage to accelerate the pulse of ions into the pulsed ion accelerator 220. The pulsed ion accelerator 220 accelerates the pulse of ions. The timed ion selector 224 transmits ions accelerated by the pulsed ion accelerator 220 into the field-free drift space 226 and rejects other ions by directing the ions along trajectory 230. The accelerated ions transmitted by the timed ion selector 224 travel a distance $D_v$ to the velocity focus point 228. The ions continue to travel through field-free region 232 to the ion reflector 240 where they are reflected so that they travel through field-free region 248 to the ion detector 250. Voltage $V_1$ is applied to the ion reflector electrode 244 and voltage $V_2$ is applied to the ion reflector electrodes 246 to focus the ions from the velocity focus point 228 to the detector 250 thereby removing the first and second order contributions of initial velocity to the ion flight time.

Figure 4:
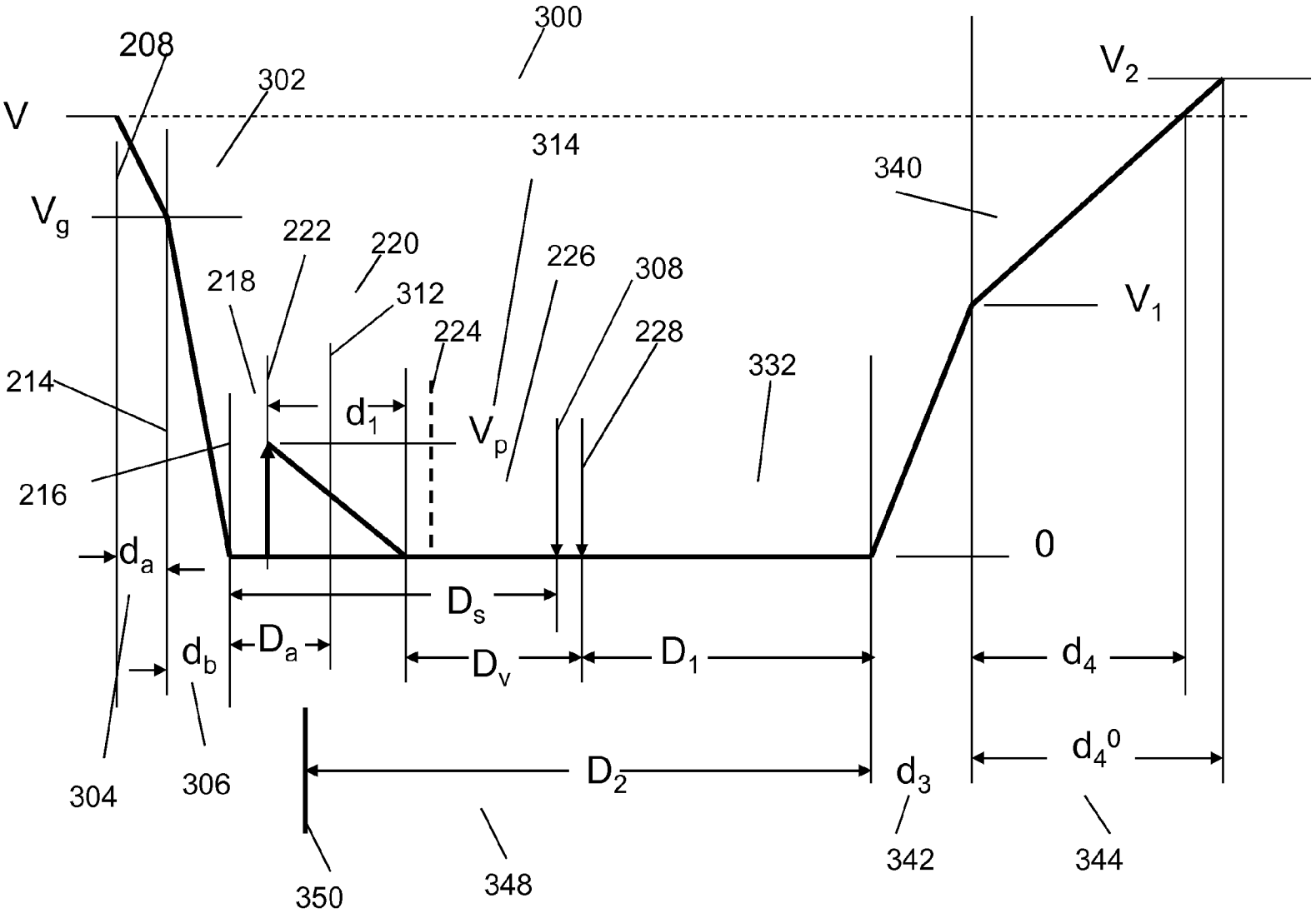
FIG. 4 shows a potential diagram for the reflector TOF mass spectrometer according to the present teaching that was described in connection with FIG. 3.

FIG. 4 shows a potential diagram 300 for the reflector TOF mass spectrometer 200 according to the present teaching that was described in connection with FIG. 3. Referring to both the reflector TOF mass spectrometer 200 shown in FIG. 3 and to the potential diagram 300 shown in FIG. 4, the potential diagram 300 includes a static two-field ion acceleration region 302. A static voltage $V_a$ is applied to the sample plate 208. A static voltage $V_g$ is applied to the first electrode 214 which is positioned a distance $d_a$ 304 away from the sample plate 208. The second electrode 216, which is positioned a distance $d_b$ 306 away from the first electrode 214, is at ground potential. The static voltages $V_a$ and $V_g$ focus the ions generated at the sample plate 208 in time at a point 308 a distance $D_s$ in field-free drift space 226. At distance $D_s$ 309, the flight time of any mass is independent (to first order) of the initial position of the ions produced from the ion sample plate 208.

At the time that an ion of predetermined mass-to-charge ratio reaches predetermined point 312 at distance $D_a$ from second electrode 216 within the pulsed accelerator 220, a pulsed voltage $V_p$ 314 is applied to the entrance plate 222 of the pulsed ion accelerator 220 which focuses the ions through the field-free drift space 226 to the focal point 228 thereby removing (to first order) the effect of initial velocity of the ions on the flight time from the pulsed accelerator 220 to the focal point 228. The voltage $V_g$ is adjusted to focus the ions generated at the sample plate 208 so that the focal point 308 where the ion flight time of any mass is independent (to first order) of the initial position of the ions produced from ion sample plate 208 coincides with focal point 228. In this way, simultaneous space and velocity focusing is achieved at focal point 228. The timed ion selector 224 located adjacent to the exit of the pulsed accelerator 220 is activated to transmit only ions accelerated by pulsed accelerator 220 and to prevent all other ions from reaching focal point 228.

Figure 5:
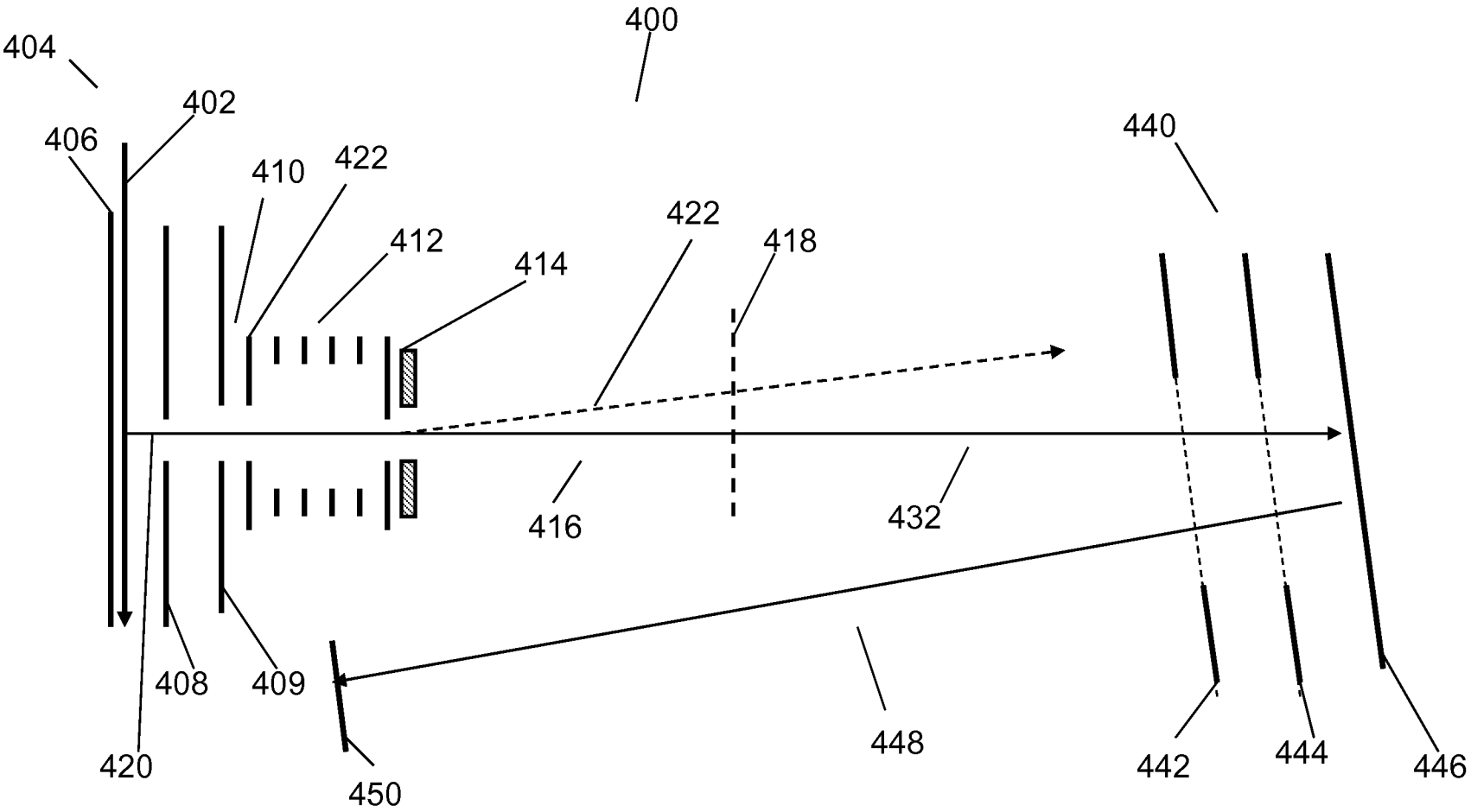
FIG. 5 shows a schematic diagram of a reflector TOF mass spectrometer according to the present teaching that includes a continuous ion source with a pulsed ion accelerator.

FIG. 5 shows a schematic diagram of a reflector TOF mass spectrometer 400 according to the present teaching that includes a continuous ion source 402 with a first pulsed ion accelerator 404. The reflector TOF mass spectrometer 400 is similar to the reflector TOF mass spectrometer 200 that was described in connection with FIG. 3. However, the reflector TOF mass spectrometer 400 includes the continuous ion source 402. The potential diagram for the reflector TOF mass spectrometer 400 according to the present teaching is similar to the potential diagram shown in FIG. 4.

Numerous types of ions sources can be used. For example, the continuous ion source 402 can be an external ion source wherein the beam of ions is injected orthogonal to the axis of the ion flight path. In some embodiments, the continuous ion source 402 is an electrospray ion source. In other embodiments, the continuous ion source 402 is an electron beam that produces ions from molecules in the gas phase.

The first pulsed ion accelerator 404 includes a first 406 and a second electrode 408 that are positioned adjacent to the continuous ion source 402, and a third electrode 409 at grounded potential. A second pulsed ion accelerator 412 is positioned adjacent to a third electrode 409. In some embodiments, a first field-free ion drift space 410 is positioned between electrode 409 and the second pulsed ion accelerator 412. A timed ion selector 414 is positioned adjacent to the second pulsed ion accelerator 412. A field-free ion drift space 416 is positioned adjacent to the timed ion selector 414. The ions travel a distance $D_v$ 311 to the velocity focus point 418. The ions continue to travel through field-free region 432 to ion reflector 440 where they are reflected to travel through field-free region 448 to the detector 450 where the ions are detected.

In operation, a continuous stream of ions 420 is generated by the continuous ion source 402. The continuous stream of ions 420 is injected into the first pulsed ion accelerator 404. A voltage pulse is periodically applied between the first 406 and the second electrode 408 to generate an electric field which accelerates a portion of the continuous stream of ions 420 in the form of a pulse of ions. The pulse of ions propagates to the second pulsed ion accelerator 412 where the pulse of ions is accelerated by a second electric field generated by the second pulsed ion accelerator 412. The timed ion selector 414 transmits ions accelerated by the second pulsed ion accelerator 412 and rejects other ions by directing the ions along trajectory 422. The accelerated ions transmitted by the timed ion selector 414 travel a distance $D_v$ 311 to the velocity focus point 418. The ions continue to travel through field-free region 432 to the ion reflector 440 where they are reflected to travel through field-free region 448 to the detector 450 where the ions are detected. Voltage $V_1$ is applied to the ion reflector electrode 444 and voltage $V_2$ is applied to the ion reflector electrode 446 in order to focus ions at the velocity focus point 418 to the detector 450, thereby removing the first and second order contributions of initial velocity to the ion flight time.

In some embodiments, the accelerating electric fields are static during ion acceleration. The accelerating electric fields are generated by constant DC voltages. In some reflector TOF mass spectrometers according to the present teaching, a pulse of ions is produced by the interaction of a pulse of energy with the sample deposited on a solid surface. Examples of such ionization are laser desorption or secondary ion mass spectrometry (SIMS). Other linear TOF mass spectrometers use gas phase ionization. Examples of such ionization are electron ionization (EI) or electrospray. In the linear TOF mass spectrometers according to the present teaching, a portion of the accelerating field may be pulsed. However, time lag focusing is not employed.

To illustrate the present teaching, an analysis of a two-field ion accelerator for a reflector TOF mass spectrometer is presented to show that both spatial and velocity focusing can be achieved simultaneously. The space focusing distance for a two-field ion accelerator is given by $$D_s=2d_a y^{3/2}[1-(d_b/d_a)/(y+y^{1/2})]$$

where $d_a$ 304 is the length of the first accelerating field, $d_b$ 306 is the length of the second accelerating field and y is the ratio of the total accelerating potential V to the accelerating potential in the first field $V_a-V_g$, where $V_g$ is the potential applied the electrode intermediate to the two fields. The total effective length of the source is given by $$D_{es}=2d_a y^{1/2}[1+(d_a/d_b)/(y^{1/2}+1)]$$

The time dispersion at the source exit due to the initial velocity of the ions is given by $$\delta t_v=(2d_a y/v_n)(\delta v_0/v_n),$$

where $\delta v_0$ is the initial velocity spread of the ions and $v_n$ is the nominal ion velocity after acceleration.

The corresponding time dispersion at the source exit due to the initial position of the ions is given by $$\delta t_s=(2d_a y/v_n)(\delta x/2d_a y)=(\delta x/v_n)$$

where δx is the spread in initial position of the ions.

The first order dependence of the flight time on the initial velocity and the initial position to a point a distance D in a field-free region adjacent to the ions source is given $$t=(D_e/v_n)[1+(D/D_e)f_1 p-(2d_a/D_e(v_0/v_n)],$$

where $$f_1=\{y^{-1}-(2d_a/D)y^{1/2}+(2d_b/D)(y^{1/12}+1)^{-1}\}.$$

The dependence on the perturbation p for a given geometry is eliminated by adjusting the voltage ratio $y=V_d/(V_a-V_g)$ so that $f_1=0$.

In known reflector mass spectrometers, the acceleration delay is adjusted to eliminate the dependence on initial velocity $v_o$ to achieve time lag focusing. The nominal final velocity $v_n$ of the ion of mass-to-charge ratio m/z is given by $$v_n=C_1(zV/m)^{1/2},$$

where m is the ion mass, z is the charge, and V is the accelerating voltage. The perturbation due to the spread in the initial position is $$p_2=(\delta x/2d_a y),$$

where δx is the spread in initial position.

Velocity focusing can also be achieved with the TOF mass spectrometer including the two-field ion accelerator 154 and the separate pulsed ion accelerator 160 according to the present teaching. To achieve velocity focusing, a pulse having an amplitude $V_p$ is applied to the separate pulsed ion accelerator 160. The first order dependence of the flight time on the initial velocity is eliminated at a distance $D_v$ 311 from the exit of the pulsed ion accelerator 160.

The kinetic energy of an ion with initial velocity $v_o$ assuming that the ion accelerator is activated at the time when an ion with zero initial velocity reaches the center of the pulsed accelerator is given by $$zV[(1+q_0(1-\delta d/2d_1)]=zV[1+q_0(1-(D_{ea}/d_1)(v_0/v_n)]=zV(1+q_0)\{1-p_1\},$$

where $V_p$ is the amplitude of the pulsed voltage, $d_1$ is the length of the accelerating field, $\delta d=2D_{ea}(v_0/v_n)$ is the position of an ion with initial velocity $v_0$ relative to that with zero initial velocity, $D_{ea}=D_{es}+D_a$, where $D_{es}$ is the effective length of the static accelerating field, $D_a$ is the distance from the end of the static field to the center of the pulsed accelerating field 313, $q_0=V_p/2V$, $p_1=[q_0/(1+q_0)](D_{ea}/d_1)(\delta v_0/v_n)$, and the initial energy is equal to zV.

The time for ions to travel to a point $D_v$ 311 in the field-free region is given by $$t=(v_2-v_1)/a+D_v/v_2,$$

where $a=zV_p/md_1$. The time for ions to travel to a point $D_v$ 311 can then be expressed as $$t=(2d/v_n)(V/V_p)[(1+q_0)^{1/2}\{1-p_1\}^{1/2}-1]+(D_v/v_n)[(1+q_0)^{-1/2}\{1-p_1\}^{-1/2}].$$

The time for ions to travel to point $D_v$ 311 to first order in initial velocity $v_0$ is then $$t=(2d/v_n)(V/V_p)[(1+q_0)^{1/2}\{1-p_1 2\}-1]+(D_v/v_n))[(1+q_0)^{-1/2}\{1+p_1/2\}].$$

Thus, the time for ions to travel to point $D_v$ 311 is independent of the perturbation in velocity focus $p_1$ if the following conditions are met:

$$2d(V/V_p)(1+q_0)^{1/2}p_1=D_v(1+q_0)^{-1/2}p_1 \text{ and}$$

$$(D_v/2d)=(1+q_0)(V/V_p)=(V_a+V)/V_p=(V/V_p)[1+q_0]=(1+q_0)/2q_0.$$

The time for ions to travel to point $D_v$ 311 as a function of the perturbation in velocity focus $p_1$ can then be expressed as:

$$t=(D_v/v_a)(1+q_0)^{-1/2}[(1-p_1)^{1/2}+(1+p_1)^{-1/2}-(1+q_0)^{-1/2}].$$

The spatial focusing error also contributes to an increase in the mass-to-charge ratio peak width. The kinetic energy of ions with the spatial focusing error is given by $zV(1-p_2)$ where the perturbation in spatial focusing is given by $$p_2=(\delta x/2d_a y).$$

At the space focus point, the ions with higher energy overtake the ions with lower energy. If the space focus is located at a greater distance than the pulsed accelerator, for example, in the vicinity of the detector, then the lower energy ions arrive at the pulsed accelerator before those with higher energy. The later arriving ions with relatively high energy are accelerated by the pulsed ion accelerator more than the ions with relatively low energy, which effectively increases their space focal distance.

Spatial focusing occurs at distance $D_s$ 309 in the absence of ion acceleration. The total flight time in the absence of ion acceleration is $[D_{es}+D_s]/v$ where $$v=v_n(1-p_2)^{1/2}.$$

The nominal flight time from the center of the pulsed accelerator to the velocity focal point $D_v$ in the field free region is $[D_v+d_1/2]/v$, where $v=v_n$ in the absence of acceleration and $v=v_n(1+q_0)^{1/2}$ with acceleration. The relative difference in flight time to point $D_v$ in the drift space is given by $$\delta t/t=v_n[v_n^{-1}-v^{-1}]=[1-(1+q_0)^{-1/2}]=\Delta D/D_v.$$

Thus, if $q_o$ is small compared to unity, then the change in spatial focal point due to the pulsed accelerator to first order is approximately give by $$\Delta D/D_v=(q_0/2).$$

It has been discovered that the space focus and the velocity focus can be made to coincide by adjusting the value of y so that $$D_s=D_v-\Delta D+D_a=D_v(1-q_0/2)+D_a,$$

where $D_a$ (shown in FIG. 4) is the distance between the grounded electrode 216 and the position 312 of ions of mass $m_0$ at the time a voltage pulse is applied to the pulsed accelerator 220.

In operation, ions of a predetermined mass are focused at the focal point 228. To first order, the peak width is zero and is independent of both initial velocity and initial position. The actual peak width at the focal point 228 depends on higher order terms in the perturbations, and is approximately equal to $[p_1^2+p_2^2]/4$.

The focus position as a function of mass can be expressed as $$(D_v/2d)=(1+q)(V/V_p),$$

where $q=q_o[1+2(D_{ea}/d_1)(1-(m_0/m)^{1/2}\}]$ and $m_0$ is the mass of the ion focused to first order at the detector positioned at the focal point 228. The relative focusing error as function of mass is then equal to $$\Delta D/D_v=[D_v(m)-D_v(m_0)]/D_v(m_0)=[(1+q)-(1+q_0)]/(1+q_0)=(q-q_0)/(1+q_0).$$

The width of the peak at the focal point 228 relative to the flight time is then given to first order by $$\delta t/t=p\Delta D/D_v=p(q-q_0)/(1+q_0).$$

Since $p_1$ and $p_2$ are independent variables, the total effective perturbation accounting for all of the initial conditions is given by $$p=[p_1^2+p_2^2]^{1/2} \text{ where}$$

$$p_1=[q_0/(1+q_0)][d_a y/d_1](\delta v_0/v_n) \text{ and}$$

$$p_2=[(1+q_0)^{-1}][(\delta x/2d_a)+\Delta E/V-V_0/V]/y.$$

The total effective perturbation due to the spatial focusing takes into account all of the sources of initial kinetic energy. Spatial focusing essentially occurs when the contribution of $p_2$ is equal to zero since the term $(\delta x/2d)$ is normally much larger than the other terms in the total effective perturbation.

The total effective perturbation due to the initial velocity is mass dependent since it depends on the final velocity of ions accelerated by the static accelerator, and therefore, the total effective perturbation is proportional to the square root of the ion mass. The final velocity distribution due to the initial ion velocity may be substantially narrowed relative to the velocity of the ions emerging from the static accelerator. The velocity distribution due to the initial position or the initial ion energy is only slightly reduced by the ratio of ion energies before and after the pulsed acceleration.

Higher order terms of the total effective perturbation may limit the resolving power at the first order focus for ions of low kinetic energy and high mass. The second order dependence on the total effective perturbation is given by $p^2/4$. However, for most useful measurements, the resolving power is limited by other factors. In particular, the time resolution limit of the measurement is often the limiting parameter in determining the total effective perturbation. The contribution to peak width caused by the time resolution limit of the measurement is given by the ratio of the bin width of the digitizer acquiring the detector data plus the nominal width of the pulses from the detector for single events to the total ion flight time. The different contributions to the peak width are independent. Therefore, the peak width for a practical system is approximately equal to the square root of the sum of squares of the individual contributions.

A linear TOF mass spectrometer has limited resolving power over typical mass ranges of interest. The addition of an ion reflector extends the time range without significantly affecting the mass-to-charge ratio peak widths. Therefore, the ion reflector substantially increases the resolving power and reduces the mass dependence of the resolving power. At the focal point of the pulsed accelerator $D_v$, the relative velocity spread due to the initial velocity spread is given by $$\delta v/v=p_1=[q/(1+q)](d_a y/d_1)(\delta v_0/v_n).$$

And the nominal kinetic energy of ions after acceleration is given by $$V(m)=V+V_a=V(1+q), \text{ where } q=q_0[1+2(D_e/d_1)(1-(m_0/m)^{1/2}\}],$$

where $q_0=V/2V_p$, and $m_0$ is the mass of the ion focused to first order. Thus, even though the kinetic energy variation as a function of mass is introduced by the pulsed accelerator, an ion reflector positioned after the pulsed ion accelerator 160 can further improve the resolving power. The first order focal length of the two-stage ion reflector is given by $$D_{em}=4d_4w^{3/2}-4d_3[w/(w^{1/2}+1)],$$

where $w=V/(V-V_1)$ and $d_4=d_4^0(V-V_1)/(V_2-V_1)$, $d_4^0$ 344 is the physical length of the second stage of the reflector and $V_1$ and $V_2$ are the voltages applied to the first and second stage, respectively, of the ion reflector 340. If the first order focal length of the two-stage ion reflector is expressed in terms of the voltage V* for the first and second order focus of the reflector, then the first order focal length of the two-stage ion reflector can be expressed as $$D_{em}/4d_3=C_1(V/V^*)w^{3/2}-[w/(w^{1/2}1)],$$

where $w=(V/V^*)/[(V/V^*)-(V_1/V^*)]$ and $C_1=(d_4^0/d_3)[V^*/(V_2-V_1)]$. The point where the first and second order focus for $V/V^*=1$ corresponds to $D_m=4d_3[w/(w-3)]$. The error in the first order focus at any value of $V/V^*$ is given by $D_{em}(V)-D_{em}(V^*)$. The ratio of energies as a function of mass for an ion source that provides both space and velocity focusing is given by $$V/V^*=[(1+q)/1+q_0].$$

In one embodiment, the ratio $V/V^*=1$ corresponds to $w=4$, but any value of w greater than three can be used. In this embodiment $$(D_{em}/4d_3)=(8/3)(V/V^*)(1-0.75^*/V)w^{3/2}-[w/(w^{1/2}+1)]$$

and $$(D_{em}/4d_3)=4 \text{ for } V/V^*=1. \text{ Thus,}$$

$$\Delta D/D(\text{reflector})=[D_{em}(m)-D_{em}(m_0)/D_{em}(m_0)]=\{(2/3)(V/V^*)(1-0.75V/V^*)w^{3/2}\}-[w/4(w^{1/2}+1)]-1.$$

And the peak width for the complete mass spectrometer as a function of mass is given by $$\delta t/t=p(\Delta D/D)_{total}=p[D_v/D_t)(\Delta D/D)_v+(D_m(D_t)(\Delta D/D)_m],$$

where $D_t=D_v+D_m$ for first order focused mass $m_0$.

Initial velocity distributions for ions produced by MALDI have been determined by several research groups. These research groups generally agree that the initial velocities are less than 1,000 m/s and are independent of the ion mass. Also, these research groups generally agree that the velocity depends on properties of the matrix and on the laser fluence. However, definitive measurements of the distribution for any particular set of operating conditions are not known. One aspect of the present teaching is that a mean value of about 400 m/s and a similar value for the width of the distribution (FWHM) accounts satisfactorily for observed behavior with 4-hydroxy-α-cyanocinnamic acid matrix. The initial position for ion formation appears to be determined primarily by the size of the matrix crystals. One aspect of the present teaching is that it has been discovered that an initial position value of 10 μm is a satisfactory approximation for many measurements.

Figure 6:
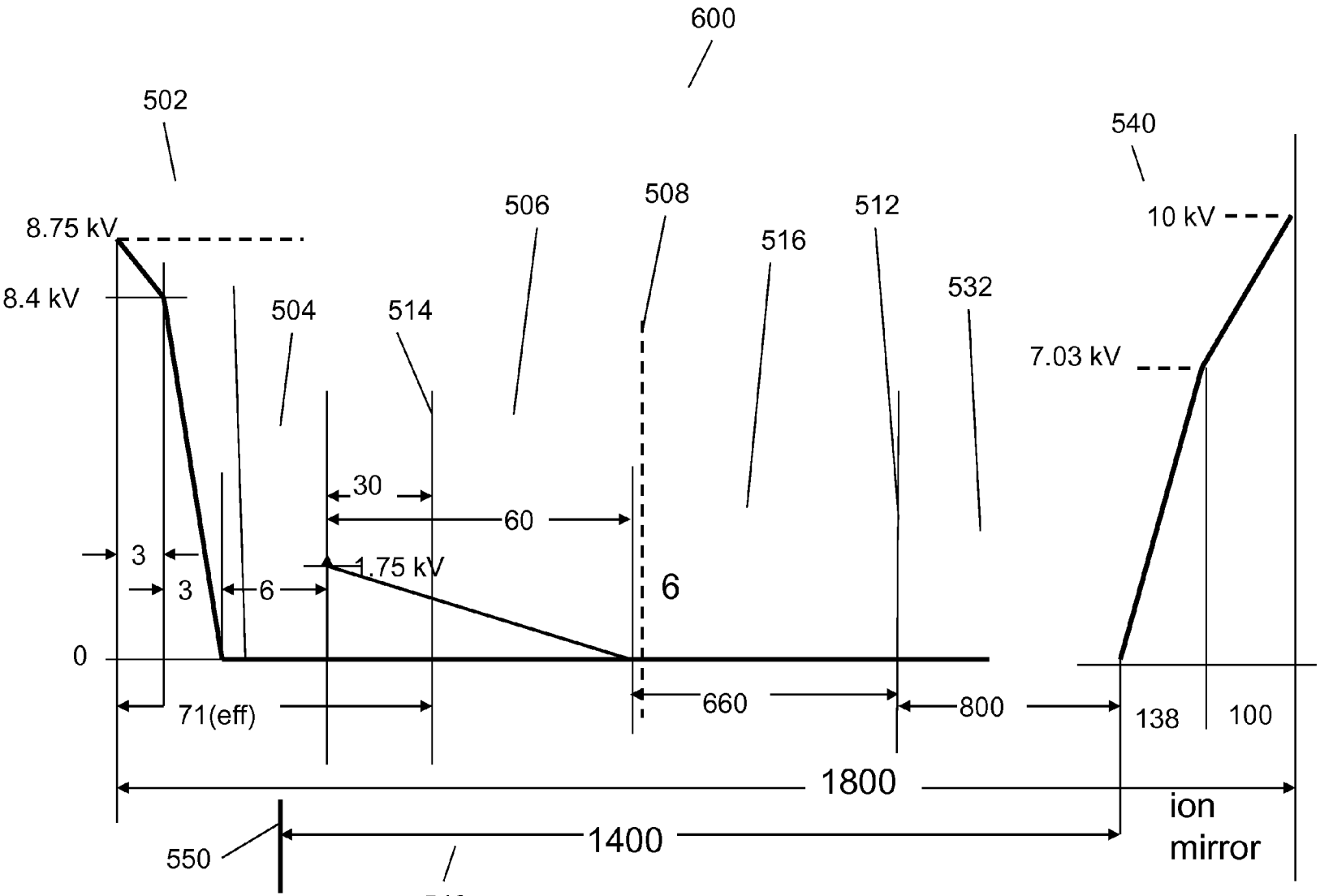
FIG. 6 shows a potential diagram for one embodiment of a reflector TOF mass spectrometer according to the present teaching that was described in connection with FIG. 3.

FIG. 6 shows a potential diagram for one embodiment of a reflector TOF mass spectrometer according to the present teaching that was described in connection with FIG. 3. Nominal dimensions in mm are indicated in the figure. The potential diagram 500 shows a two-field ion source region 502 with an initial first electric field and a second electric field beginning 3 mm into the ion source region 502 and extending for 3 mm. In the example shown in the potential diagram 500, a potential of 8.75 kV is applied to a static ion accelerator 502 in the two-field ion source, and a potential of 8.4 kV is applied to the intermediate electrode of the static ion accelerator. A pulse of 1.25 kV potential is applied to pulsed accelerator 506.

A first field-free drift space 504 extends 6 mm from the exit of the two-field ion source region 502. An ion lens (not shown) can be positioned in the first field-free drift space 504 to focus the ions into a collimated beam. A pulsed acceleration region 506 extends 60 mm from the first field-free drift space 504. A timed ion selector 508 is positioned at the exit of the pulsed acceleration region 506. A second field-free drift space 516 extends 660 mm from the timed ion selector 508 to the focal point 512 where the flight time is independent (to first order) of both the initial velocity and the initial position.

In operation, the potentials shown in the potential diagram 500 are chosen so that the voltage applied to the intermediate electrode in the static accelerator is adjusted so that the space focus, with modification by the pulsed accelerator, occurs at focal point 512. For the reflector TOF mass spectrometer geometry associated with the potential diagram 500, a voltage difference across the first stage of the static accelerator needs to be about 0.35 kV. The pulsed accelerator is activated when the predetermined mass $m_0$ is substantially at position 514, about 30 mm into the pulsed acceleration region 506 that has a total length of 60 mm. The spatial focus is substantially independent of the mass of the ions. Ions of mass $m_0$ are focused, to first order, in both initial velocity and in initial position at focal point 512 and are refocused at the detector by the ion reflector 540.

The geometry shown in the potential diagram 500 in FIG. 6 corresponds to a value $q_0=0.1$, the focal length for velocity focusing is given by $$(D_v/2d_1)=(1+q_0)(V/V_p)=5.5.$$

Thus, the distance to the first order velocity focus point, $D_v=660$ as shown in FIG. 6. The focal length for space focusing is given by $$D_s=2d_a y^{3/2}[1-(d_b/d_a)/(y^{1/2}+y)]=36+D_v(1-q_0/2)=663.$$

The focal length equation for space focusing can be solved numerically with the length of the first accelerating field $d_a=3$ and the length of the second accelerating field $d_b=3$, to give $y=23.6$ and $V-V_g=0.37$ kV. The relative focusing error as function of mass is equal to $$\Delta D/D_v=(q-q_0)/(1+q_0),$$

where $q=q_o[1+2(D_{ea}/d_1)(1-(m_0/m)^{1/2}]$ and $m_0$ is the mass of the ion focused to first order at focal point 228. For the geometry illustrated in FIG. 6, $D_{ea}=D_{es}+6+30$, and $$D_{es}=2d_a y^{1/2}[1+(d_b/d_a)/(1+y^{1/2})]=35;$$

Thus, $D_{ea}/d_1=71/60=1.183$; then $q/q_0=[3.367-2.367(m_0/m)^{1/2}]$ and the maximum mass focused ($q/q_0=2$) is $m_{max}=3m_0$ and the minimum mass ($q/q_0=0$) is $m_{min}=0.5m_0$.

Thus, the total mass range for focusing with this geometry is about a factor of six.

The contribution of the uncertainty in initial position is negligible in these cases compared to the contribution to the uncertainty due to initial velocity. Thus, the mass dependence of the focusing at $D_v$ is given by $$\delta m/m = 2(q-q_0)/(1+q_0)\{q_0/(1+q_0)[d_a y/d_1](\delta v_0/v_n)\}$$
$$= 2q_0^2[(q/q_0)-1]/(1+q_0)^2[(d_a y/d_1)(\delta v_0/v_n)$$

$$\Delta D/D(\text{reflector}) = \{(2/3)(V/V^*)(1-0.75V^*/V)w^{3/2}\}-[(w/4)/(w^{1/2}+1)]-1,$$

$$\text{where } V/V^* = (1+q)/(1+q_0) \text{ and } w = (V/V^*)/[(V/V^*)-0.75].$$

And the peak width for the complete mass spectrometer as a function of mass is given by $$\delta t/t=p(\Delta D/D)_{total}=p[D_v/D_t)(\Delta D/D)_v+(D_m(D_t)(\Delta D/D)_m],$$

where $D_t=D_v+D_m$ for first order focused mass $m_0$.

The other major contribution to peak width is determined by the time resolution of the measurement. Typically, the time resolution of the measurement is limited by the single ion pulse width for the detector and the bin width of the digitizer. For example, in one TOF mass spectrometer according to the present teaching, the single ion pulse width for the detector is 0.5 ns and the bin width for the detector is 0.5 ns resulting in a total time uncertainty of 1 ns. The total flight time from the source to detector is given by the effective distance divided by the velocity. For the mass spectrometer geometry corresponding to the potential diagram shown in FIG. 6, the effective flight distance is approximately 3,800 mm and the velocity for an ion with a 9 kV ion energy is 0.0417 $m^{1/2}$ mm/ns for mass m in kDa. Thus, the contribution to peak width from the time resolution of the measurement is $$(\delta m/m)_t = 2\delta t/t = 2\ m^{-1/2}(1)(0.0417)/3800 = 2.19\times10^{-5}\ m^{-1/2}.$$

Figure 7:
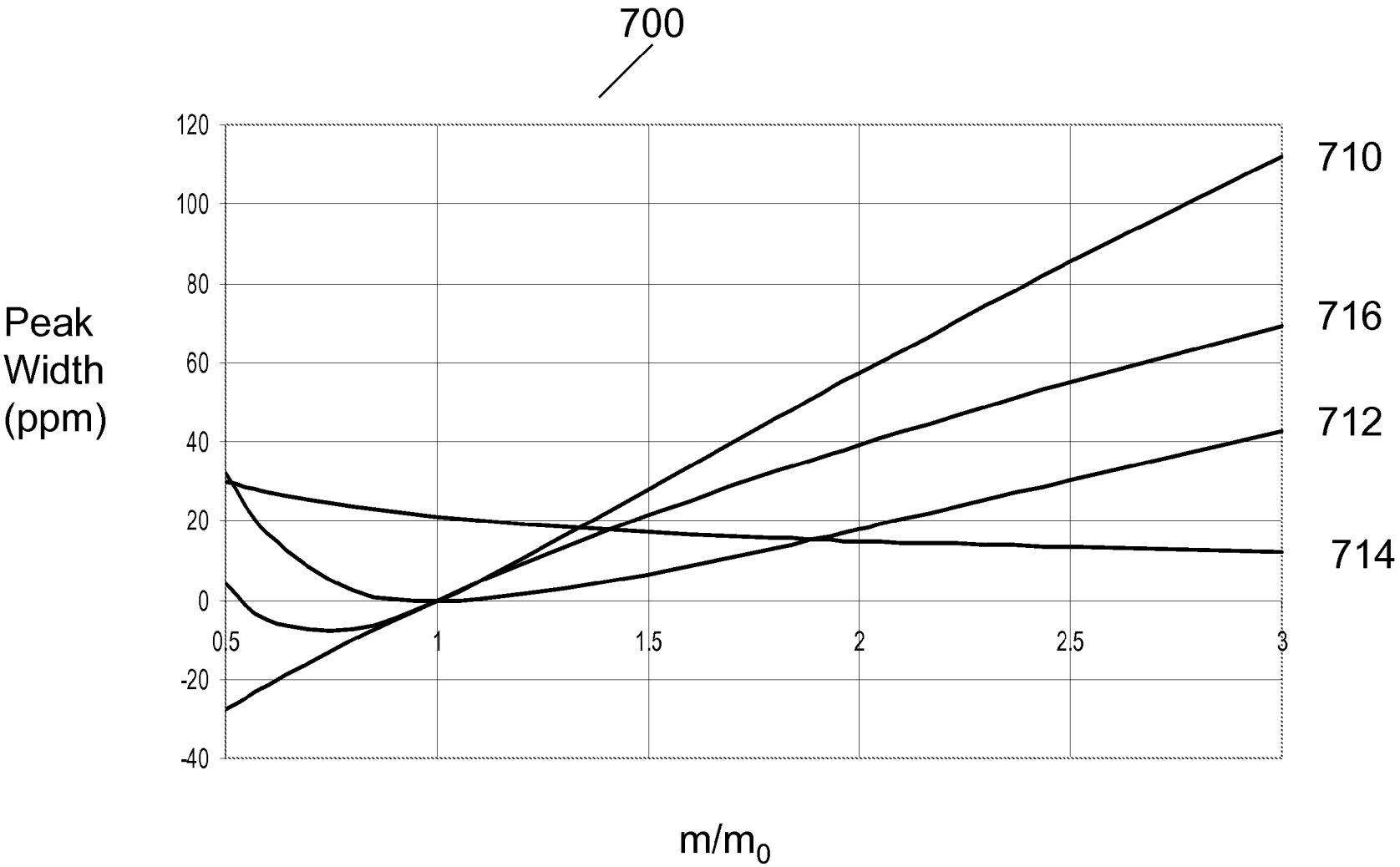
FIG. 7 shows a plot of calculated peak widths corresponding to contributions from source and ion reflector focusing errors and uncertainty in time measurement for an embodiment of the reflector TOF mass spectrometer that was described in connection with the potential diagram shown in FIG. 6.

Since the focusing error and the time measurement uncertainty are independent, the peak width is given by the square root of the sum of squares of the individual contributions of the peak width due to the uncertainty in the initial velocity and the uncertainty in the time resolution of the measurement. FIG. 7 shows plots 700 of calculated peak widths corresponding to contributions from source and reflector focusing errors and uncertainty in time measurement for an embodiment of the reflector TOF mass spectrometer that was described in connection with the potential diagram shown in FIG. 6. The contribution to the peak width due to focusing errors in the source is shown in plot 710 as functions of mass-to-charge ratio. The contribution to the peak width due to focusing errors in the reflector is shown in plot 712 as functions of mass-to-charge ratio. The contribution to the peak width due to time measurement uncertainty is shown in plot 714 as functions of mass-to-charge ratio. The plot 716 represents the sum of the focusing errors in the source shown in the plot 710 and the contribution to the peak width due to focusing errors in the reflector shown in plot 712. The plot 716 illustrates a reduction of the total error at masses lower than $m_0$. At lower masses, the resolving power is primarily determined by the time measurement uncertainty 714.

Figure 8:
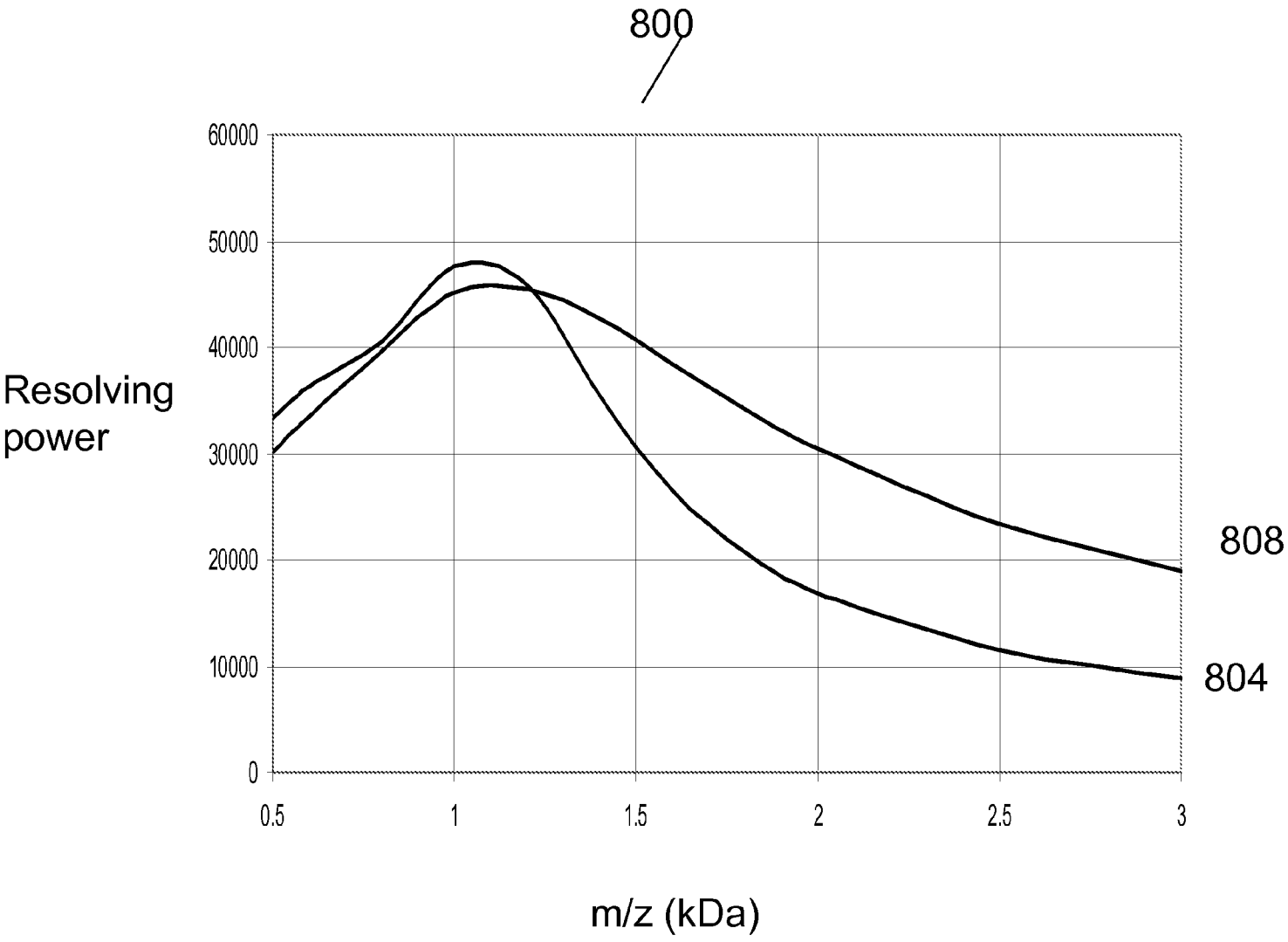
FIG. 8 illustrates a plot of calculated resolving power as function of mass in kD for an embodiment of a TOF mass spectrometer according to the present teaching that is described in connection with the potential diagram shown in FIG. 6 using MALDI ionization for first order focusing at $m_0$=1 kDa compared with the calculated resolving power for a known TOF mass spectrometer.

FIG. 8 illustrates a plot 800 of calculated resolving power as function of mass in kD for an embodiment of a TOF mass spectrometer according to the present teaching that is described in connection with the potential diagram shown in FIG. 6 using MALDI ionization for first order focusing at $m_0$=1 kDa compared with the calculated resolving power for a known TOF mass spectrometer. The calculations for resolving power as a function of mass are performed for time lag focusing conditions with the same effective length as those illustrated in potential diagrams shown in FIG. 6. These calculations employ initial conditions that are typically encountered with MALDI ionization and correspond to first order focusing at 1 kDa. More specifically, FIG. 8 shows the calculated resolving power as function of mass in kD 804 for a TOF mass spectrometer with the potential diagram shown in FIG. 6. In addition, FIG. 8 shows the calculated resolving power as function of mass in kD 808 for a prior art TOF mass spectrometer using time lag focusing.

The data illustrated in FIG. 8 indicate that the calculated resolving power 708 as function of mass for prior art TOF mass spectrometers using time lag focusing is lower than the resolving power that can be achieved using TOF mass spectrometers according to the present teaching at lower masses. However, the calculated resolving power 808 as function of mass for prior art TOF mass spectrometers using time lag focusing may be higher than the resolving power than can be achieved using TOF mass spectrometers according to the present teaching at some higher masses.

Figure 9:
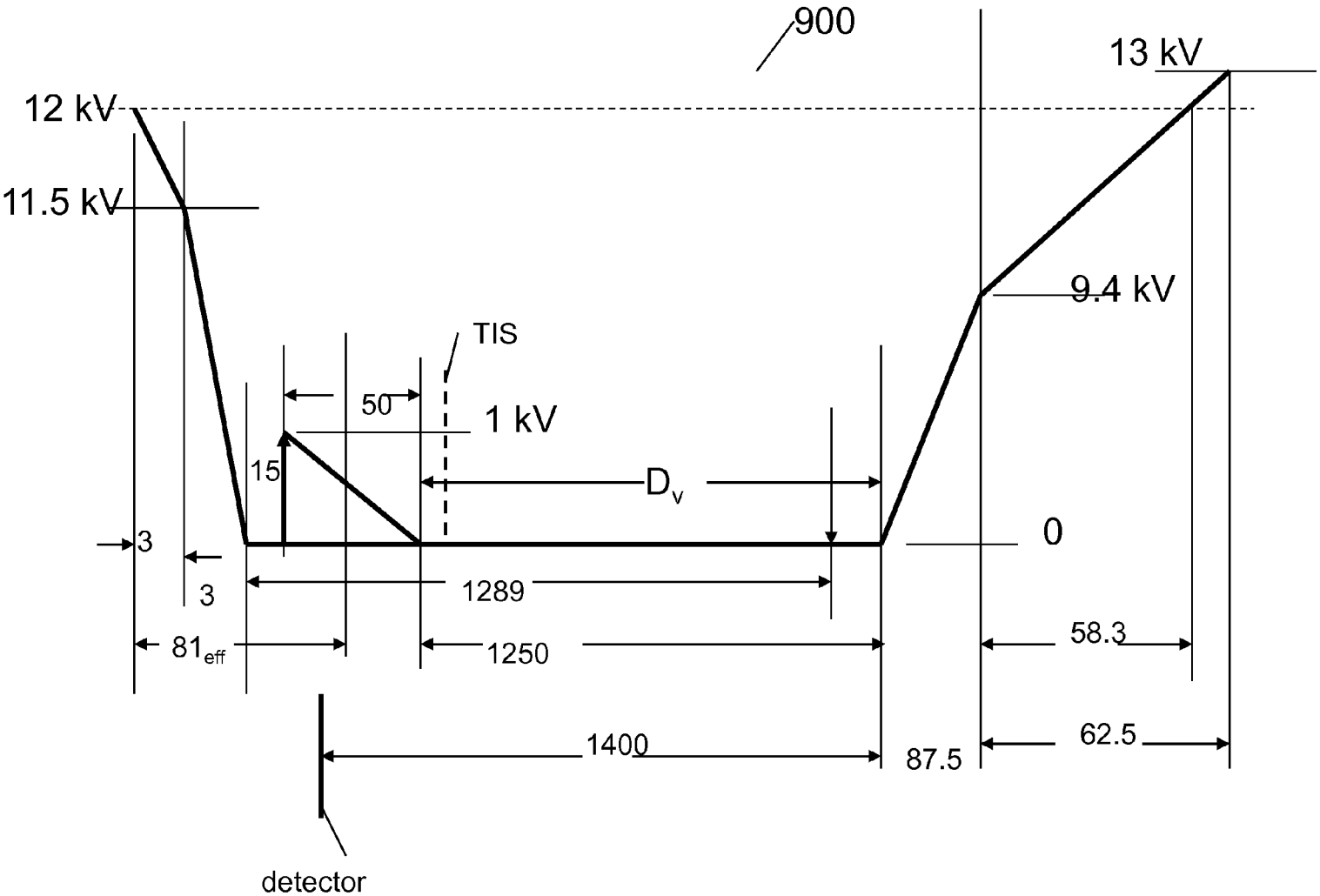
FIG. 9 shows a potential diagram for another embodiment of a reflector TOF mass spectrometer according to the present teaching that was described in connection with FIG. 3.

FIG. 9 shows a potential diagram 900 for another embodiment of a reflector TOF mass spectrometer according to the present teaching that was described in connection with FIG. 3. In this embodiment, the focal length $D_v$ is increased to 1,250 mm. This allows higher resolving power over the range of first order focus, but reduces the mass range that can be focused. For the geometry illustrated in FIG. 9, y=36.5, $q_0$=1/24, $D_{es}$+81, and $$D_{ea}/d_1 = 81/50 = 1.62;\ \text{then}$$

$q/q_0=[3.62-2.62(m_0/m)^{1/2}]$ and the maximum mass focused ($q/q_0$=2) is $m_{max}=2.09m_0$ and the minimum mass ($q/q_0$=0) is $m_{min}=0.58m_0$.

Thus, the total mass range for focusing with this geometry is about a factor of 3.6.

Figure 10:
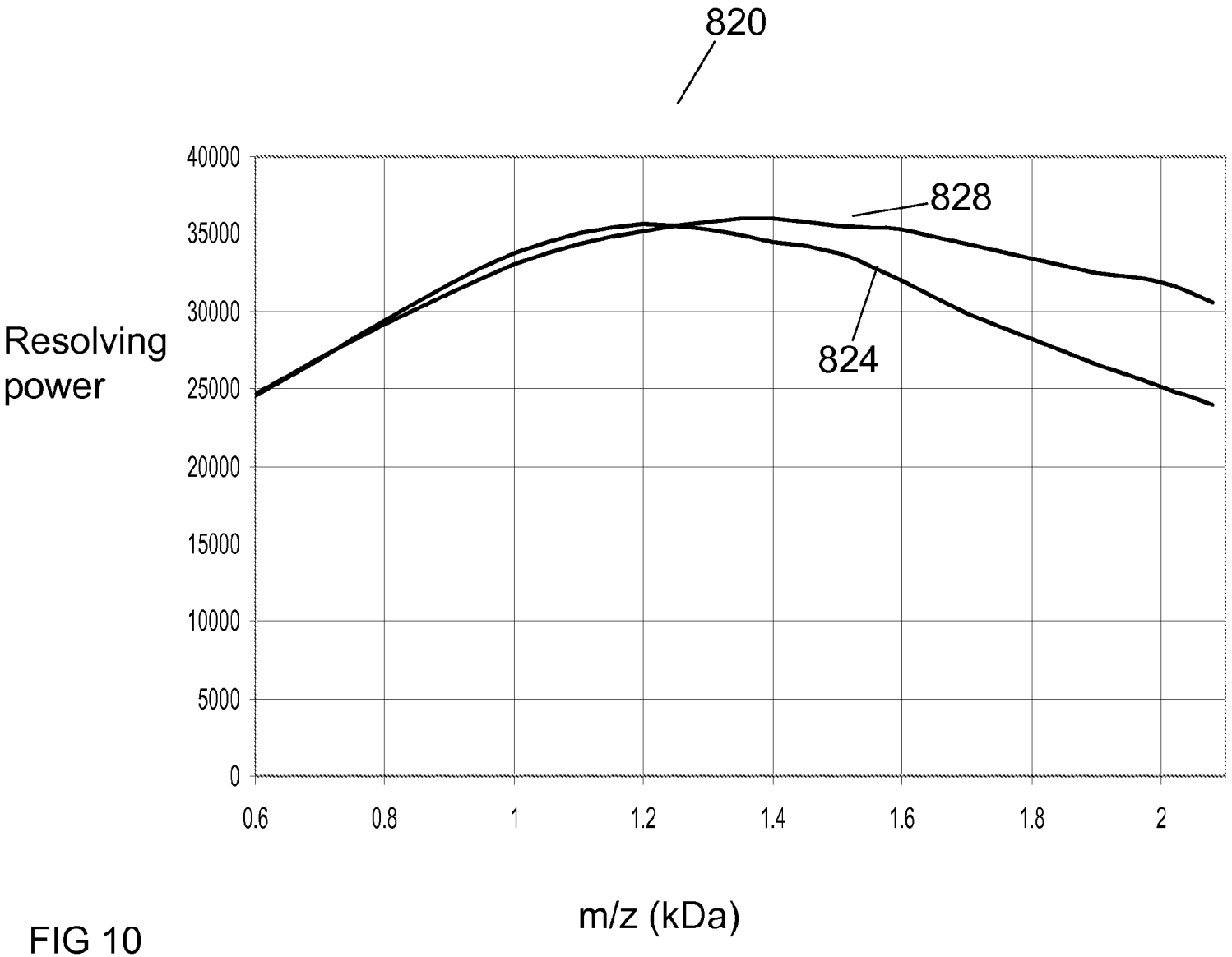
FIG. 10 illustrates a plot of calculated resolving power as function of mass in kD for an embodiment of a TOF mass spectrometer according to the present teaching that is described in connection with the potential diagram shown in FIG. 9 using MALDI ionization for first order focusing at $m_0$=1 kDa compared with the calculated resolving power for a known TOF mass spectrometer.

FIG. 10 illustrates a plot of calculated resolving power 820 as function of mass in kD for an embodiment of a TOF mass spectrometer according to the present teaching that is described in connection with the potential diagram shown in FIG. 9 using MALDI ionization for first order focusing at $m_0$=1 kDa compared with the calculated resolving power for a known TOF mass spectrometer. The calculations for resolving power as a function of mass are performed for time lag focusing conditions with the same effective length as those illustrated in the potential diagrams shown in FIG. 9. These calculations employ initial conditions that are typically encountered with MALDI ionization and that correspond to first order focusing at 1 kDa. More specifically, FIG. 10 shows the calculated resolving as function of mass in kD 824 for a TOF mass spectrometer corresponding to the potential diagram shown in FIG. 9. In addition, FIG. 10 shows the calculated resolving power as function of mass in kD 828 for a prior art TOF mass spectrometer using time lag focusing. In this embodiment, the resolving power is primarily limited by the time measurement uncertainty. High resolving power is obtained over the full range of focus with mass spectrometers according to the present teaching. However, the prior art mass spectrometer with time lag focusing provides slightly higher theoretical resolving power at higher masses.

Theoretically, the resolving power of a TOF mass spectrometer increases approximately in proportion to the effective length of the ion flight path in the instrument. We have discovered that the practical resolving power of prior art reflection time-of-flight mass spectrometers is actually limited by small errors in the performance of the two-stage ion reflector that must provide very accurate first and second order corrections to maintain a high resolving power.

Figure 11:
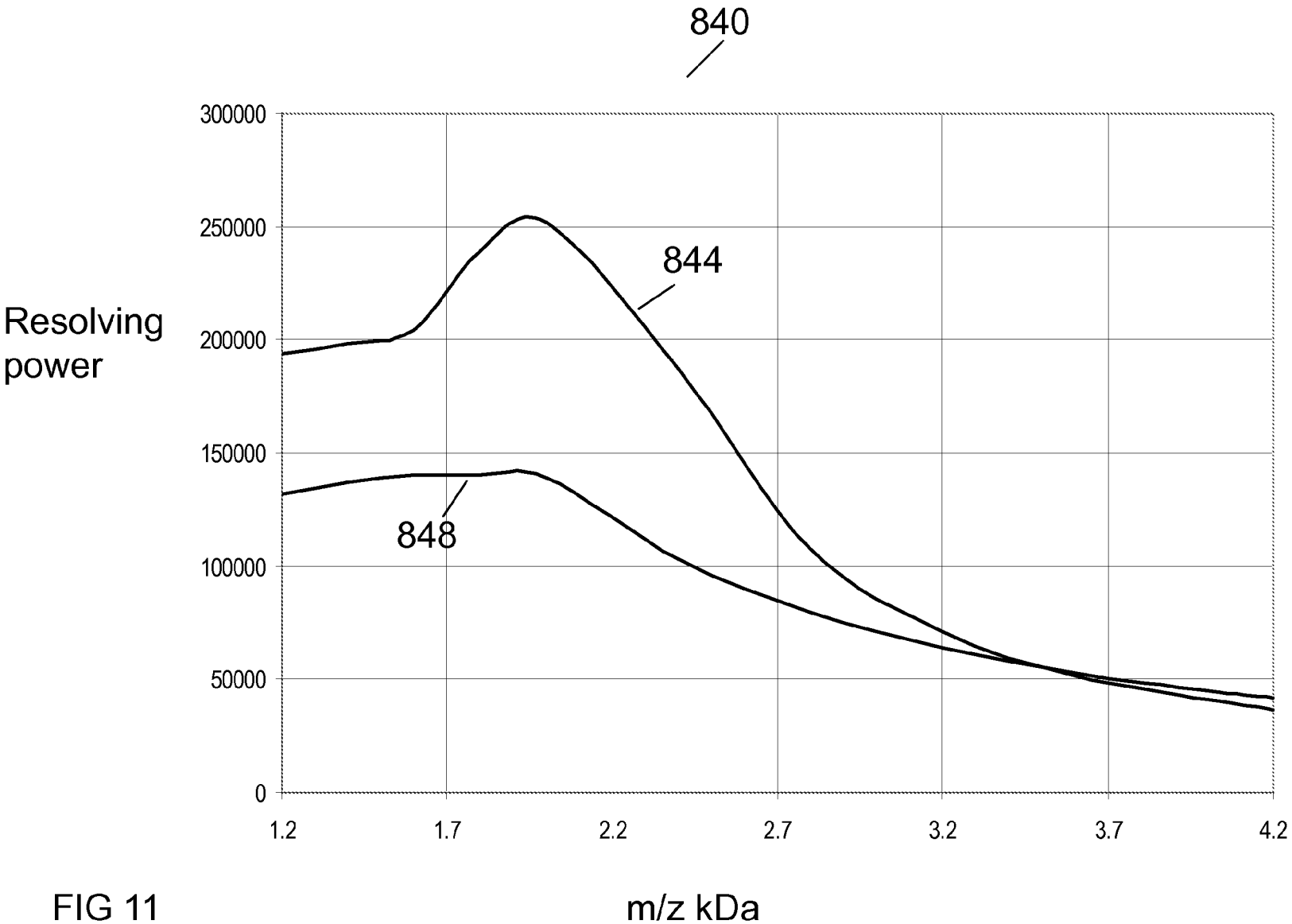
FIG. 11 illustrates a plot of calculated resolving power as function of mass in kD for an embodiment of a TOF mass spectrometer that was described in connection with the schematic diagram of the reflector TOF mass spectrometer shown in FIG. 3 having an effective flight path length of 14 m and using MALDI ionization for first order focusing at $m_0$=2 kDa compared with a calculated resolving power for a known TOF mass spectrometer.

FIG. 11 illustrates plots 840 of calculated resolving power as function of mass in kD for an embodiment of a TOF mass spectrometer that was described in connection with the schematic diagram of the reflector TOF mass spectrometer shown in FIG. 3 having an effective ion flight path length of 14 m and using MALDI ionization for first order focusing at $m_0$=2 kDa compared with a calculated resolving power for a known TOF mass spectrometer. In this case, the errors due to focusing of the source effectively cancel errors due to the reflector at lower masses and very high resolving power is obtained over a broad mass range. In this case, the focus mass is chosen as $m_0$=2 kDa, V=8 kV, $q_0$=1/22, y=34.6.

The calculations for resolving power as a function of mass are performed for time lag focusing conditions with the same effective ion flight path length. These calculations employ initial conditions that are typically encountered with MALDI ionization and correspond to first order focusing at 2 kDa. More specifically, FIG. 11 shows the calculated resolving as function of mass in kD 844 for a optimized TOF mass spectrometer with 14 m. In addition, the plots 840 show the calculated resolving power as function of mass in kD 848 for a prior art TOF mass spectrometer using time lag focusing with a 14 m effective ion flight path length. In this embodiment, the limitation due to time measurement uncertainty is relatively small. High resolving power is obtained over the full range of focus according to the present teaching.

EQUIVALENTS

While the Applicant's teachings are described in conjunction with various embodiments, it is not intended that the Applicant's teachings be limited to such embodiments. On the contrary, the Applicant's teachings encompass various alternatives, modifications, and equivalents, as will be appreciated by those of skill in the art, which may be made therein without departing from the spirit and scope of the teaching.

What is claimed is:

1. A time-of-flight mass spectrometer comprising:

a. an ion source that generates ions;

b. a two-field ion accelerator having an input that receives the ions generated by the ion source, the two-field ion accelerator generating an electric field that accelerates the ions generated by the ion source through an ion flight path;

c. a pulsed ion accelerator positioned in the ion flight path adjacent to the two-field ion accelerator, the pulsed ion accelerator generating an accelerating electric field that focuses the ions to a first focal plane where the ion flight time to the first focal plane for an ion of predetermined mass-to-charge ratio is substantially independent to first order of an initial velocity of the ions prior to the acceleration;

d. an ion reflector positioned in the ion flight path that focuses ions to a second focal plane where the ion flight time to the second focal plane for an ion of predetermined mass-to-charge ratio is substantially independent to first order of an initial velocity of the ions prior to the acceleration; and e. an ion detector positioned at the second focal plane for detecting ions, the two-field ion accelerator and the ion reflector generating electric fields that cause the ion flight time to the ion detector for the ion of predetermined mass-to-charge ratio to be substantially independent to first order of both the initial position and the initial velocity of the ions prior to the acceleration.

2. The mass spectrometer of claim 1 wherein the ion reflector comprises a two-field ion reflector.

3. The mass spectrometer of claim 1 wherein the ion source comprises a pulsed ion source and a first field generated by the two-field ion accelerator comprises a static accelerating electric field.

4. The mass spectrometer of claim 1 wherein the ion source comprises a continuous source and a first field generated by the two-field ion accelerator comprises a pulsed accelerating electric field.

5. The mass spectrometer of claim 4 wherein the ion source comprises an external ionization source.

6. The mass spectrometer of claim 4 wherein the ion source comprises an electrospray ionization source.

7. The mass spectrometer of claim 4 wherein the ion source comprises an electron beam source.

8. The mass spectrometer of claim 1 wherein the ion source comprises a pulsed ion beam source.

9. The mass spectrometer of claim 1 wherein the ion source comprises a continuous ionization source.

10. The mass spectrometer of claim 1 wherein the sample is positioned on a solid surface.

11. The mass spectrometer of claim 10 wherein the ion source comprises a pulsed laser.

12. The mass spectrometer of claim 10 wherein the ion source comprises a MALDI ion source.

13. The mass spectrometer of claim 1 further comprising a timed ion selector positioned in the ion flight path adjacent to the pulsed ion accelerator, the timed ion selector transmitting ions accelerated by the pulsed ion accelerator and preventing all other ions from passing.

14. The mass spectrometer of claim 1 further comprising an ion lens positioned in the ion flight path between the two-field ion accelerator and the pulsed accelerator, the ion lens spatially focusing the ions to the ion detector.

15. The mass spectrometer of claim 1 further comprising at least one ion steering electrode positioned in the ion flight path between the two-field ion accelerator and the pulsed accelerator.

16. A method for generating high resolution mass spectra by time-of-flight mass spectrometry, the method comprising:

a. generating a pulse of ions from a sample;

b. accelerating the pulse of ions with a first and second electric field;

c. further accelerating the pulse of ions accelerated by the first and second electric fields with a pulsed electric field that focuses ions to a first focal plane where an ion flight time to the first focal plane for an ion of predetermined mass-to-charge ratio is substantially independent to first order of an initial velocity of the ions prior to the acceleration;

d. adjusting the first and second electric fields to cause the ion flight time to the first focal plane for ions of the predetermined mass-to-charge ratio to be independent to first order of both an initial position and an initial velocity of the ions prior to the acceleration;

e. reflecting ions with an ion reflector to a second focal plane where ions having the predetermined mass-to-charge ratio are independent to first order of both the initial position and the initial velocity of the ions prior to the acceleration; and f. detecting ions at the second focal plane.

17. The method of claim 16 wherein the sample comprises a MALDI sample.

18. The method of claim 16 wherein the generating the pulse of ions comprises irradiating the sample with a pulsed laser.

19. The method of claim 16 further comprising selecting ions from the pulse of ions after the accelerating the pulse of ions with the pulsed electric field and passing only selected ions.

20. The method of claim 16 further comprising spatially focusing ions in the ion flight path after acceleration by the first and the second electric fields to the first focal plane.

21. The method of claim 16 further comprising steering ions in the ion flight path after the accelerating the pulse of ions with the first and second electric field.

22. The method of claim 16 wherein the generating the pulse of ions comprises generating the pulse of ions with a pulsed ion source and wherein the first electric field comprises a static electric field.

23. The method of claim 16 wherein the generating the pulse of ions comprises generating the pulse of ions with a continuous ion source and wherein the first electric field comprises a pulsed accelerating electric field.

* * * * *